US011976872B2

(12) United States Patent
Tadokoro et al.

(10) Patent No.: US 11,976,872 B2
(45) Date of Patent: May 7, 2024

(54) AXIAL FLOW FAN, AIR-SENDING DEVICE, AND REFRIGERATION CYCLE APPARATUS

(71) Applicant: Mitsubishi Electric Corporation, Tokyo (JP)

(72) Inventors: Takahide Tadokoro, Tokyo (JP); Katsuyuki Yamamoto, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 332 days.

(21) Appl. No.: 17/604,849

(22) PCT Filed: Jun. 25, 2019

(86) PCT No.: PCT/JP2019/025152
§ 371 (c)(1),
(2) Date: Oct. 19, 2021

(87) PCT Pub. No.: WO2020/261379
PCT Pub. Date: Dec. 30, 2020

(65) Prior Publication Data

US 2022/0221214 A1 Jul. 14, 2022

(51) Int. Cl.

| | |
|---|---|
| ***F25D 17/06*** | (2006.01) |
| ***F04D 19/00*** | (2006.01) |
| ***F04D 29/38*** | (2006.01) |

(52) U.S. Cl.
CPC ..... *F25D 17/067* (2013.01); *F04D 19/002* (2013.01); *F04D 29/384* (2013.01)

(58) Field of Classification Search
CPC ..... F04D 19/002; F04D 29/384; F05D 2240/301; F05D 2240/304; F05D 2240/307
See application file for complete search history.

(56) References Cited

U.S. PATENT DOCUMENTS

| | | | | |
|---|---|---|---|---|
| 9,051,941 | B2 * | 6/2015 | Kojima | F04D 29/384 |
| 11,098,734 | B2 * | 8/2021 | Nakashima | F04D 29/661 |
| 2020/0240429 | A1 | 7/2020 | Tadokoro et al. | |

FOREIGN PATENT DOCUMENTS

| | | | |
|---|---|---|---|
| JP | H11-210691 | A | 8/1999 |
| JP | 2007-218104 | A | 8/2007 |

(Continued)

OTHER PUBLICATIONS

Office Action dated Apr. 4, 2023 issued in corresponding CN patent application No. 201980097581.6 ( and Machine translation).

(Continued)

*Primary Examiner* — Lionel Nouketcha
(74) *Attorney, Agent, or Firm* — POSZ LAW GROUP, PLC

(57) ABSTRACT

An axial flow fan includes a hub driven to rotate and configured to serve as a rotation axis of the axial flow fan and a blade connected to the hub. The blade has a leading edge and a trailing edge. The trailing edge has an indentation indenting toward the leading edge. The indentation narrows from the trailing edge to the leading edge, and has an apex being a point closest to the leading edge from among the points constituting the indentation. The blade has, at the indentation, a maximum thickness portion at which a thickness of the blade is maximum, and which is positioned radially inside of the apex.

13 Claims, 20 Drawing Sheets

(56) References Cited

FOREIGN PATENT DOCUMENTS

| | | | | |
|---|---|---|---|---|
| JP | 2011-179331 | A | | 9/2011 |
| JP | 2011179331 | A | * | 9/2011 |
| JP | 2012-047080 | A | | 3/2012 |
| JP | 2013-249787 | A | | 12/2013 |
| JP | 2014-088788 | A | | 5/2014 |
| WO | 2018/158859 | A1 | | 9/2018 |

OTHER PUBLICATIONS

Extended European Search Report dated Jun. 1, 2022 issued in corresponding European Patent Application No. 19935631.2.
Examination Report dated Mar. 29, 2022 issued in corresponding IN patent application No. 202127052668.
Office Action dated May 10, 2022 issued in corresponding JP patent application No. 2021-528699 ( and English translation).
International Search Report of the International Searching Authority dated Sep. 10, 2019 in corresponding International Patent Application No. PCT/JP2019/025152 (and English translation).

* cited by examiner

Comparative Example

Comparative Example

Comparative Example

AXIAL FLOW FAN, AIR-SENDING DEVICE, AND REFRIGERATION CYCLE APPARATUS

CROSS REFERENCE TO RELATED APPLICATION

This application is a U.S. national stage application of PCT/JP2019/025152 filed on Jun. 25, 2019, the contents of which are incorporated herein by reference.

TECHNICAL FIELD

The present disclosure relates to an axial flow fan including a plurality of blade each having a trailing edge having an indentation, an air-sending device including the axial flow fan, and a refrigeration cycle apparatus including the air-sending device.

BACKGROUND ART

A conventional axial flow fan includes a plurality of blades along a circumferential surface of a cylindrical boss, and is configured to convey a fluid with the blades rotating with a rotative force applied to the boss. Rotation of the blades of the axial flow fan causes a portion of the fluid that is present between the blades to collide with blade surfaces. The surfaces with which the fluid collides are subjected to raised pressures, and the fluid is moved by being pressed in a direction of an axis of rotation serving as a central axis on which the blades rotate.

Among such axial flow fans, there has been proposed an axial flow fan provided with a serration portion having serrated projections by providing a trailing edge with a plurality of triangular indentations, the projections each having a central portion that is thick in a radial longitudinal section and an edge portion that is thin in the radial longitudinal section (see, for example, Patent Literature 1).

CITATION LIST

Patent Literature

Patent Literature 1: Japanese Unexamined Patent Application Publication No. 11-210691

SUMMARY OF INVENTION

Technical Problem

The axial flow fan of Patent Literature 1 is supposed to reduce noise generation by generating only small vortices by causing airflows flowing along an outer surface of a blade to smoothly merge at the serration portion of the trailing edge. However, the axial flow fan of Patent Literature 1 has a risk that when a centrifugal force entailed by rotation of the blade causes an airflow to be released at a place off an edge portion at which an airflow is thin, a strong blade tip vortex may be generated by a slipstream generated at an edge portion at which an airflow is thick.

The present disclosure is intended to solve such a problem, and has as an object to provide an axial flow fan configured to inhibit the growth of a blade tip vortex at an edge portion, especially at a trailing edge, an air-sending device including the axial flow fan, and a refrigeration cycle apparatus including the air-sending device.

Solution to Problem

An axial flow fan according to an embodiment of the present disclosure includes a hub driven to rotate and configured to serve as a rotation axis of the axial flow fan and a blade connected to the hub. The blade has a leading edge and a trailing edge. The trailing edge has an indentation indenting toward the leading edge. The indentation narrows from the trailing edge to the leading edge, and has an apex being a point closest to the leading edge from among the points constituting the indentation. The blade has, at the indentation, a maximum thickness portion at which a thickness of the blade is maximum, and which is positioned radially inside of the apex.

An air-sending device according to an embodiment of the present disclosure includes the axial flow fan thus configured, a drive source configured to apply a drive force to the axial flow fan, and a casing configured to house the axial flow fan and the drive source.

A refrigeration cycle apparatus according to an embodiment of the present disclosure includes the air-sending device thus configured and a refrigerant circuit having a condenser and an evaporator. The air-sending device is configured to send air to at least either the condenser or the evaporator.

Advantageous Effects of Invention

According to the embodiment of the present disclosure, the axial flow fan is configured such that a thickness of a portion of the blade that is positioned inside of the apex is a maximum thickness. The axial flow fan can reduce a speed difference in a slipstream generated and inhibit the growth of a blade tip vortex, as the apex, at which a wind velocity is high, is smaller in blade thickness than the maximum thickness portion.

DESCRIPTION OF EMBODIMENTS

In the following, an axial flow fan, an air-sending device, and a refrigeration cycle apparatus according to embodiments are described with reference to the drawings. In the following drawings including FIG. 1, relative relationships in dimension between constituent elements, the shapes of the constituent elements, or other features of the constituent elements may be different from actual ones. Further, constituent elements given identical reference signs in the following drawings are identical or equivalent to each other, and these reference signs are adhered to throughout the full text of the description. Further, the directive terms (such as "upper", "lower", "right", "left", "front", and "back") used as appropriate for ease of comprehension are merely so written for convenience of explanation, and are not intended to limit the placement or orientation of a device or a component.

Embodiment 1

[Axial Flow Fan 100]

Figure 1:
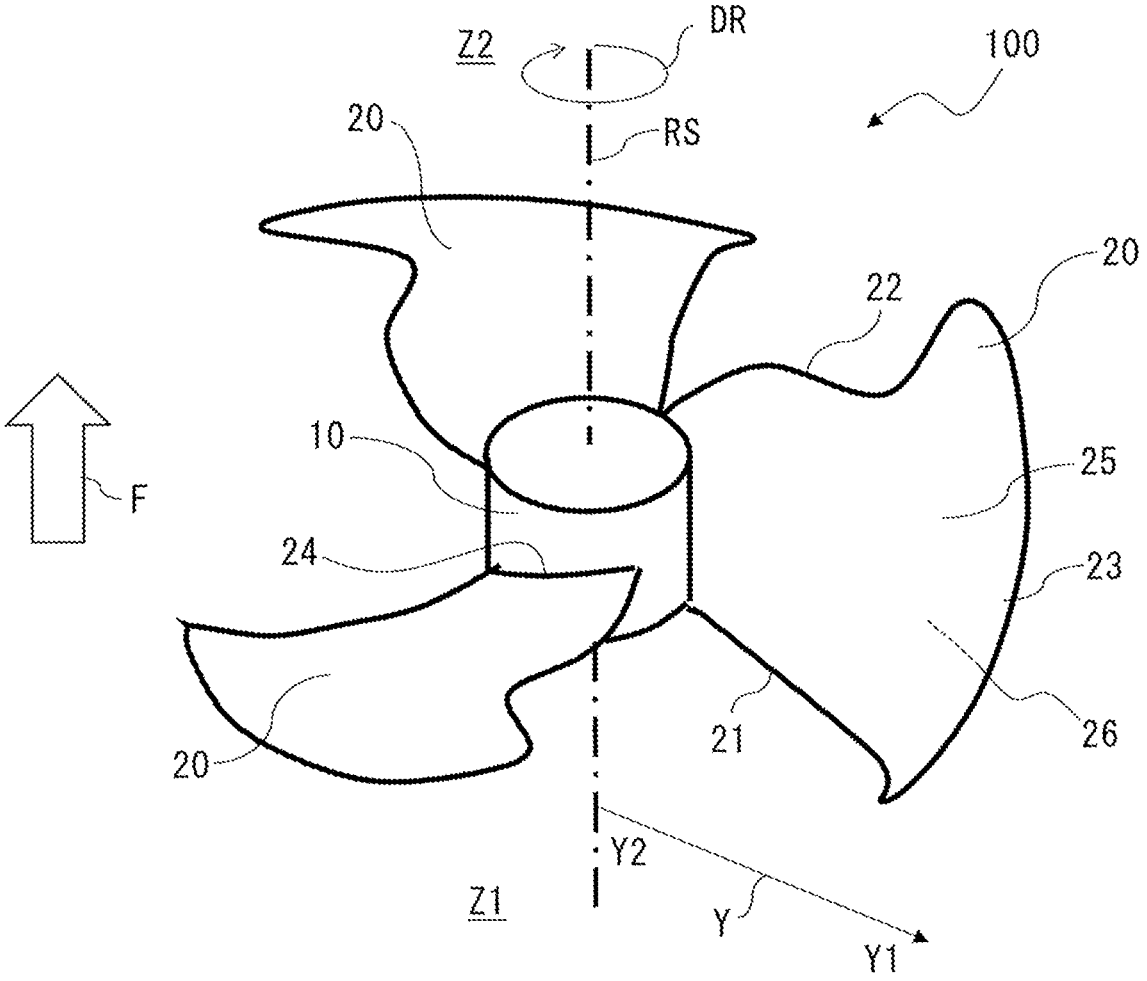
FIG. 1 is a perspective view schematically showing a configuration of an axial flow fan according to Embodiment 1.

FIG. 1 is a perspective view schematically showing a configuration of an axial flow fan 100 according to Embodiment 1. The direction of rotation DR indicated by an arrow in FIG. 1 indicates the direction of rotation DR of the axial flow fan 100. In FIG. 1, the solid-white arrow F indicates the direction F in which an airflow flows. In the direction F in which an airflow flows, a Z1 side of the axial flow fan 100 is an upstream side of the airflow with respect to the axial flow fan 100, and a Z2 side of the axial flow fan 100 is a downstream side of the airflow with respect to the axial flow fan 100. That is, the Z1 side is a suction side of air with respect to the axial flow fan 100, and the Z2 side is a blowout side of air with respect to the axial flow fan 100. Further, the Y axis represents the direction of the radius of the axial flow fan 100 with respect to the rotation axis RS. A Y2 side of the axial flow fan 100 is an inner peripheral side of the axial flow fan 100, and a Y1 side of the axial flow fan 100 is an outer peripheral side of the axial flow fan 100.

The axial flow fan according to Embodiment 1 is described with reference to FIG. 1. The axial flow fan 100 is used, for example, in an air-conditioning apparatus, a ventilating apparatus, or other apparatuses. As shown in FIG. 1, the axial flow fan 100 includes a hub 10 provided on the rotation axis RS and a plurality of blades 20 connected to the hub 10.

(Hub 10)

The hub 10 is driven to rotate and configured to serve as a rotation axis RS of the axial flow fan 100. The hub 10 rotates on the rotation axis RS. The direction of rotation DR of the axial flow fan 100 is a counterclockwise direction indicated by an arrow in FIG. 1. Note, however, that the direction of rotation DR of the axial flow fan 100 is not limited to a counterclockwise direction. For example, by varying the angle of mounting of the blades 20 or the orientation of the blades 20, the axial flow fan 100 may be configured to rotate in a clockwise direction. The hub 10 is connected to a rotation shaft of a drive source such as a motor (not illustrated). The hub 10 may be configured in the shape of a cylinder or may be configured in the shape of a plate. The hub 10 is not limited to any particular shape, provided the hub 10 is connected to the rotation shaft of the drive source as mentioned above.

(Blade 20)

The plurality of blades 20 are configured to radially extend radially outward from the hub 10. The plurality of blades 20 are circumferentially placed at spacings from each other. While Embodiment 1 illustrates an aspect in which three blades 20 are provided, any number of blades 20 may be provided.

Each of the blades 20 has a leading edge 21, a trailing edge 22, an outer peripheral edge 23, and an inner peripheral edge 24. The leading edge 21 is placed upstream (Z1 side) in an airflow generated, and is furthest forward in the direction of rotation DR in the blade 20. That is, the leading edge 21 is placed in front of the trailing edge 22 in the direction of rotation DR. The trailing edge 22 is placed downstream (Z2 side) in the airflow generated, and is furthest rearward in the direction of rotation DR in the blade 20. That is, the trailing edge 22 is placed behind the leading edge 21 in the direction of rotation DR. The axial flow fan 100 has the leading edge 21 as a blade tip portion facing in the direction of rotation DR of the axial flow fan 100, and has the trailing edge 22 as a blade tip portion opposite to the leading edge 21 in the direction of rotation DR.

The outer peripheral edge 23 is a portion extending back and forth and in an arc to connect an outermost peripheral portion of the leading edge 21 and an outermost peripheral portion of the trailing edge 22. The outer peripheral edge 23 is placed at an end portion of the axial flow fan 100 in the direction of the radius (i.e. a Y-axis direction). The inner peripheral edge 24 is a portion extending back and forth and in an arc between an innermost peripheral portion of the leading edge 21 and an innermost peripheral portion of the trailing edge 22. The blades 20 have their inner peripheral edges 24 connected to the outer periphery of the hub 10.

The blades 20 are at a predetermined angle of inclination with respect to the rotation axis RS. The blades 20 convey a fluid by pressing gas present between the blades 20 with blade surfaces as the axial flow fan 100 rotates. A surface of each of these blade surfaces that is subjected to a pressure raised by pressing the fluid serves as a pressure surface 25, and a surface behind the pressure surface 25 that is subjected to a pressure drop serves as a suction surface 26. A surface of each of the blades 20 situated upstream (Z1 side) of the blade 20 with respect to the direction in which the airflow flows serves as a suction surface 26, and a surface of each of the blades 20 situated downstream in a Z2 direction) serves as a pressure surface 25. In FIG. 1, a surface of each of the blades 20 facing toward a viewer who looks at FIG. 1 serves as a pressure surface 25, and a surface of each of the blades 20 facing away from the viewer serves as a suction surface 26.

Figure 2:
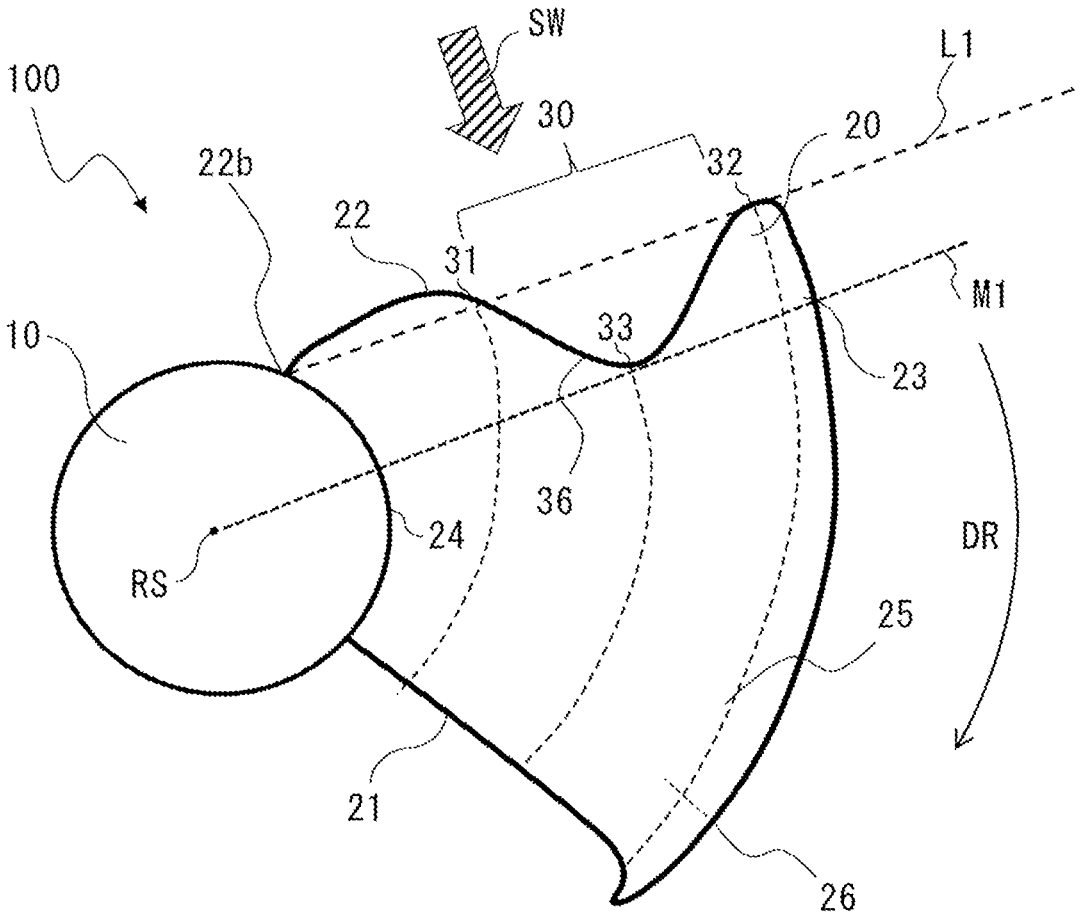
FIG. 2 is a plan view of a blade shown in FIG. 1 as seen from an angle parallel with an axial direction of a rotation axis.

FIG. 2 is a plan view of a blade 20 shown in FIG. 1 as seen from an angle parallel with an axial direction of the rotation axis RS. In other words, FIG. 2 is a diagram of the blade 20 as seen in a plane perpendicular to the rotation axis RS. As shown in FIG. 2, the trailing edge 22 of the blade 20 has one indentation 30. The indentation 30 is near a radially central portion of the trailing edge 22. The indentation 30 is a first indentation with respect to the after-mentioned second indentation.

The indentation 30, which is the first indentation, is a portion at which a wall constituting the trailing edge 22 indents toward the leading edge 21. Alternatively, the indentation 30 is a portion at which the wall constituting the trailing edge 22 indents in the direction of rotation DR. In other words, the indentation 30 indents in a direction opposite to the direction of rotation DR, and is open in a direction opposite to the direction of rotation DR.

In a plan view of the blade 20 shown in FIG. 1 as seen from an angle parallel with the axial direction of the rotation axis RS, the indentation 30 is a portion at which a blade plate of the blade 20 serving as the trailing edge 22 is notched into a U shape or a V shape. That is, the indentation 30 narrows from the trailing edge 22 to the leading edge 21. The U shape or the V shape is an example of the shape of the indentation 30 in a plan view, and the shape of the indentation 30 in a plan view is not limited to the U shape or the V shape.

The indentation 30 is defined as a portion of the trailing edge 22 that has a concave shape and extends further forward in the direction of rotation DR than a first straight line L1 connecting a basal portion 22*b* of the trailing edge 22 and a trailing edge end portion 32 of the trailing edge 22. The basal portion 22*b* is a portion at which the hub 10 and the trailing edge 22 intersect. The trailing edge end portion 32 is the outermost peripheral end portion of the trailing edge 22. Alternatively, the trailing edge end portion 32 is a portion of the trailing edge 22 that is close to the outer peripheral edge 23 and projects in a direction opposite to the direction of rotation of the axial flow fan 100. The trailing edge end portion 32 is positioned outside of than the after-mentioned apex 33. In a plan view of the blade 20 as seen from an angle parallel with the axial direction of the rotation axis RS, the straight line L1 intersects the trailing edge 22 at at least one point between the basal portion 22*b* and the trailing edge end portion 32.

An intersection portion 31 is a point of intersection at which the first straight line L1 and the trailing edge 22 intersect, and is further inward than the trailing edge end portion 32. The trailing edge end portion 32 is further outward than the intersection portion 31. The intersection portion 31 is an inner peripheral end portion of the indentation 30, and the trailing edge end portion 32 is an outer peripheral end portion of the indentation 30. The indentation 30 is a portion of the trailing edge portion 22 that is between the intersection portion 31, which is the inner peripheral end portion of the indentation 30, and the trailing edge end portion 32, which is the outer peripheral end portion of the indentation 30.

A relationship of each position of the indentation 30 in the direction of rotation DR is discussed here in terms of a relationship between a point of intersection of a second straight line M1 radially extending from the rotation axis RS and the indentation 30 and an angle of rotation of the second straight line M1 in a plan view as seen from an angle parallel with the axial direction of the rotation axis RS. Moreover, a point of intersection of the second straight line M1 and the indentation 30 in a part of the indentation 30 that is furthest forward in the direction of rotation DR is defined as an apex 33 of the indentation 30. In a case in which the amount by which the indentation 30 indents in the direction of rotation DR is expressed as "depth", the apex 33 is closest to the leading edge 21 from among the points constituting the indentation 30, and constitutes a deep part of the indentation 30. The apex 33 is between the intersection portion 31 of the trailing edge 22 and the trailing edge end portion 32. That is, the indentation 30 is formed such that the intersection portion 31, the apex 33, and the trailing edge end portion 32 are arranged in this order from the inner periphery toward the outer periphery of the trailing edge 22. The indentation 30 is open in a direction opposite to the direction of rotation DR, and a part of the indentation 30 that is close to the apex 33 is narrower than a part of the indentation 30 that is between the intersection portion 31 and the trailing edge end portion 32.

Figure 3:
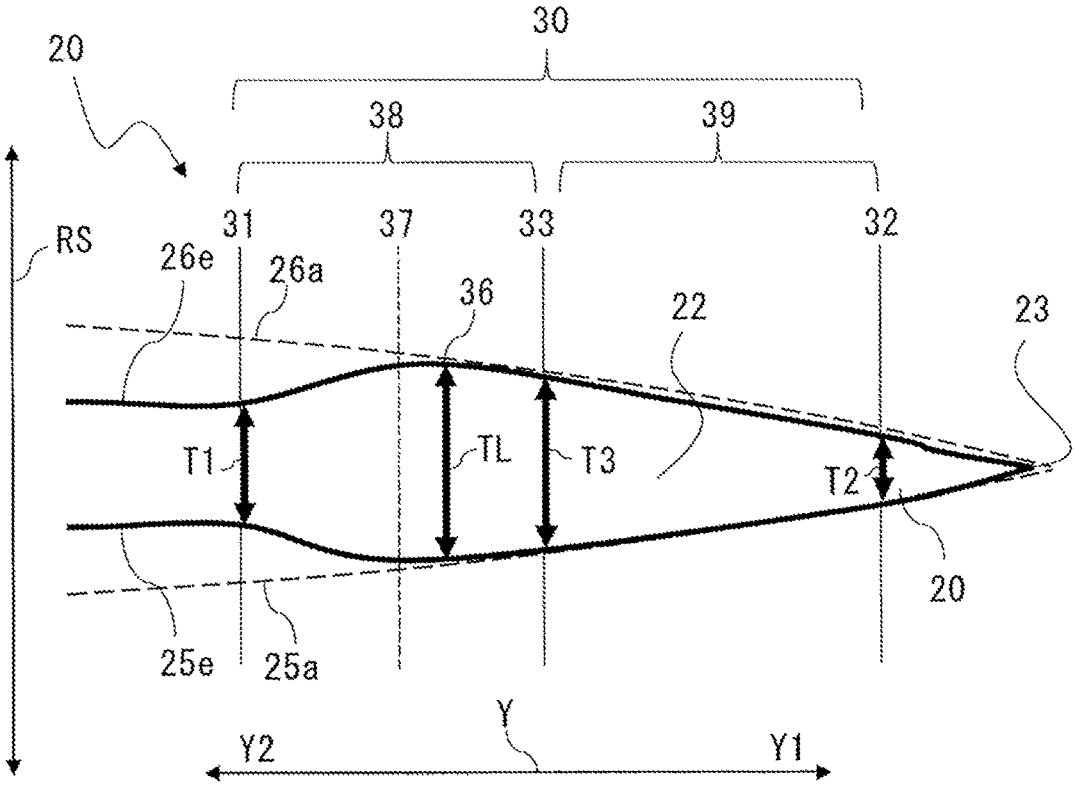
FIG. 3 is a side view conceptually showing an example of a distribution of blade thickness of a trailing edge shown in FIG. 2.
Figure 4:
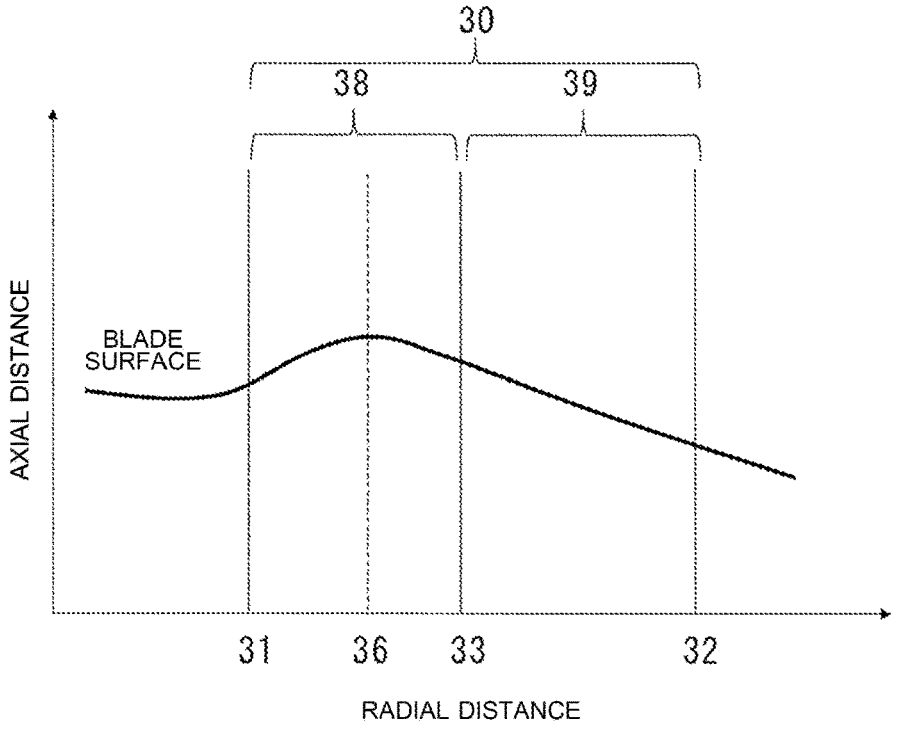
FIG. 4 is a diagram showing a blade surface distribution of the trailing edge of the axial flow fan according to Embodiment 1.

FIG. 3 is a side view conceptually showing an example of a distribution of blade thickness of the trailing edge 22 shown in FIG. 2. FIG. 4 is a diagram showing a blade surface distribution of the trailing edge 22 of the axial flow fan 100 according to Embodiment 1. FIG. 3 is a conceptual diagram showing the blade thickness of the blade 20 and the blade thickness of the trailing edge 22 as seen from an angle indicated by an arrow SW in FIG. 2. In FIG. 3, a pressure surface 25*a* indicates a portion of the pressure surface 25 of the blade 20 that is further forward in the direction of rotation DR than the trailing edge 22, and a pressure surface 25*e* represents the pressure surface 25 of the trailing edge 22. Further, in FIG. 3, a suction surface 26*a* indicates a portion of the suction surface 26 of the blade 20 that is further forward in the direction of rotation DR than the trailing edge 22, and a suction surface 26*e* represents the suction surface 26 of the trailing edge 22. FIG. 4 plots radial distance in abscissa and axial distance in ordinate, and conceptually represents an axial change in blade surface of the trailing edge in a radial direction. The blade surface shown in FIG. 4 is the pressure surface 25 or the suction surface 26. Next, the blade thickness of the trailing edge 22 is described with reference to FIGS. 3 and 4.

The blade thickness of the blade 20 is defined as a distance between a part of the pressure surface 25 and a part of the suction surface 26 that are at the same radial distance from the rotation axis RS. Moreover, the blade thickness of the trailing edge 22 is defined as a distance between a part of the pressure surface 25 of the trailing edge 22 and a part of the suction surface 26 of the trailing edge 22 that are at the same radial distance from the rotation axis RS. For example, as shown in FIG. 3, the blade thickness of the blade 20 at the intersection portion 31 is a blade thickness T1. Further, the blade thickness of the blade 20 at the apex 33 is a blade thickness T3. Furthermore, the blade thickness of the blade 20 at the trailing edge end portion 32 is a blade thickness T2. The blade thickness of the blade 20 may be defined as a distance in the axial direction of the rotation axis RS between a part of the pressure surface 25 of the trailing edge 22 and a part of the suction surface 26 of the trailing edge 22 that are at the same radial distance from the rotation axis RS. Moreover, the blade thickness of the trailing edge 22 may be defined as a distance in the axial direction of the rotation axis RS between a part of the pressure surface 25 of the trailing edge 22 and a part of the suction surface 26 of the trailing edge 22 that are at the same radial distance from the rotation axis RS.

Figure 5:
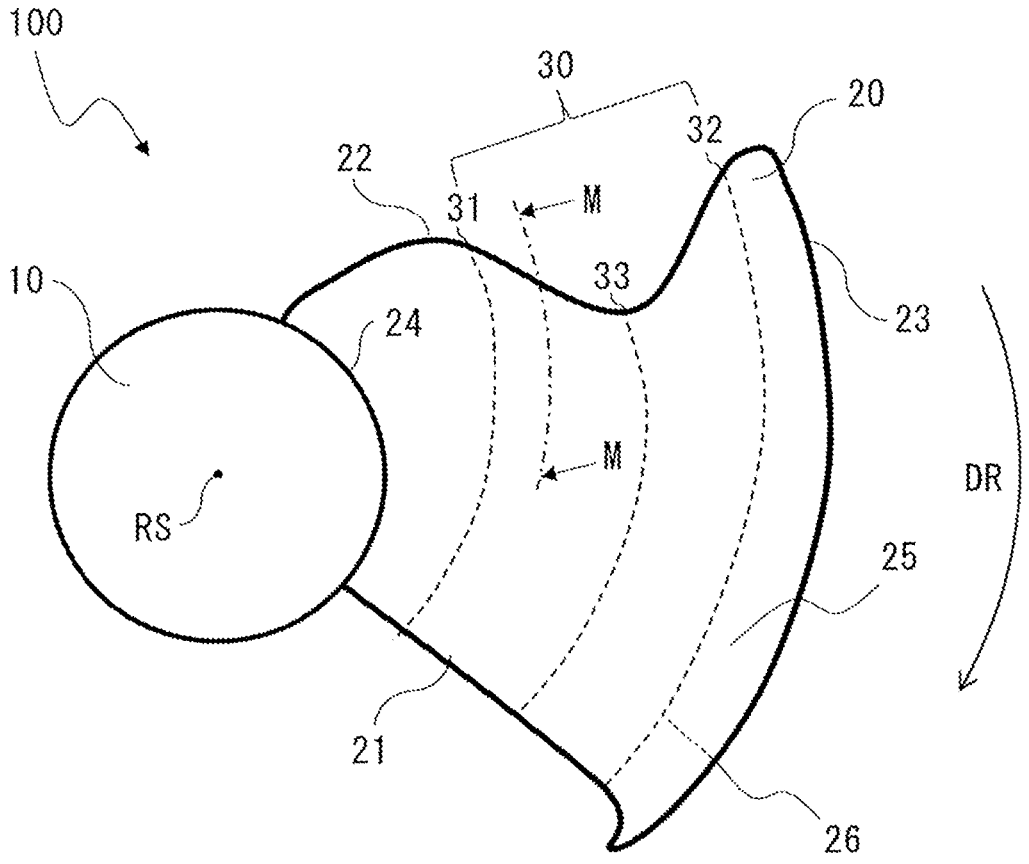
FIG. 5 is another plan view of a blade shown in FIG. 1 as seen from an angle parallel with the axial direction of the rotation axis.
Figure 6:
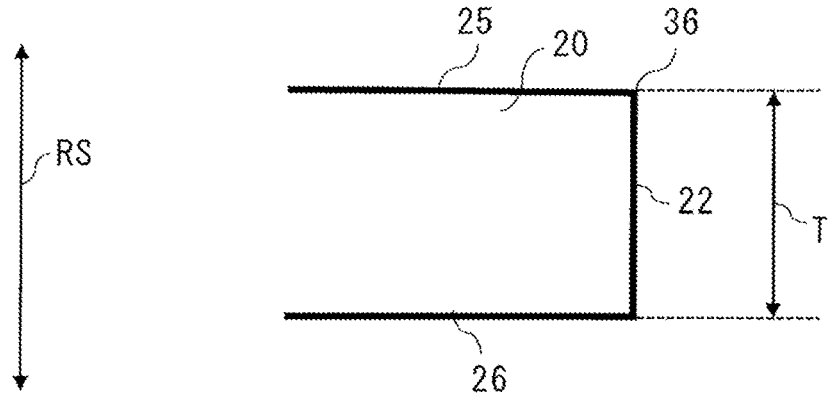
FIG. 6 is a diagram conceptually showing a shape of a cross-section of the trailing edge of the blade shown in FIG. 5 as taken along line M-M.
Figure 7:
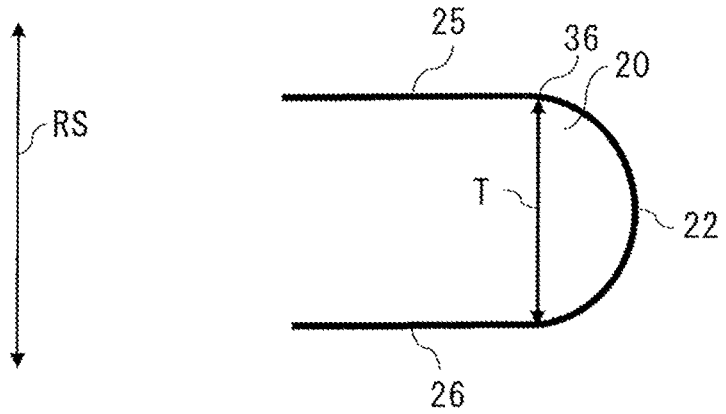
FIG. 7 is a diagram conceptually showing a shape of another cross-section of the trailing edge of the blade shown in FIG. 5 as taken along line M-M.
Figure 8:
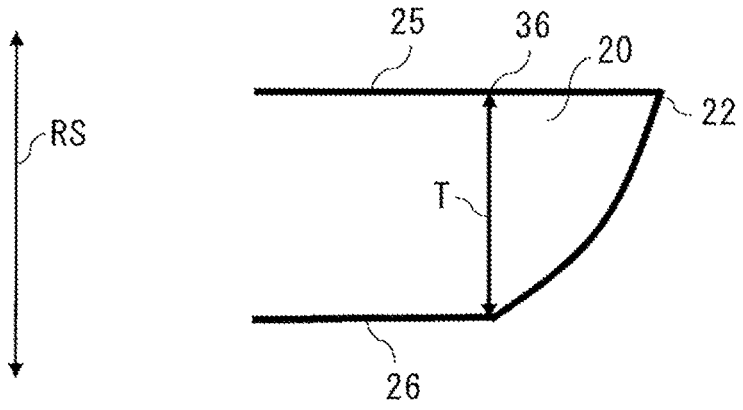
FIG. 8 is a diagram conceptually showing a shape of another cross-section of the trailing edge of the blade shown in FIG. 5 as taken along line M-M.

FIG. 5 is another plan view of a blade 20 shown in FIG. 1 as seen from an angle parallel with the axial direction of the rotation axis RS. FIG. 6 is a diagram conceptually showing a shape of a cross-section of the trailing edge 22 of the blade 20 shown in FIG. 5 as taken along line M-M. FIG. 7 is a diagram conceptually showing a shape of another cross-section of the trailing edge 22 of the blade 20 shown in FIG. 5 as taken along line M-M. FIG. 8 is a diagram conceptually showing a shape of another cross-section of the trailing edge 22 of the blade 20 shown in FIG. 5 as taken along line M-M. As shown in FIG. 6, in a case in which the trailing edge 22 is rectangular, the blade thickness is defined as that of a portion of the trailing edge 22 at the blade tip. Further, as shown in FIG. 7, in a case in which the trailing edge 22 has a round shape, the blade thickness is defined as that of a portion of the trailing edge 22 at a starting point of the round shape. Further, as shown in FIG. 8, in a case in which the trailing edge 22 has a pointed end, the blade thickness is defined as that of a portion of the trailing edge 22 at a starting point of the pointed end. The blade thickness of the trailing edge 22 shown in FIGS. 6 to 8 is shown as the blade thickness T in FIGS. 6 to 8.

As shown in FIGS. 3 and 4, the indentation 30 of the trailing edge 22 increases in blade thickness outward from the intersection point 31 and reaches a maximum blade thickness inside of the apex 33. The blade 20 has, at the indentation 30, a maximum thickness portion 36 at which a thickness of the blade 20 is maximum, and which is positioned radially inside of the apex 33. Thus, the indentation 30 of the blade 20 has the maximum thickness portion 36 in an area between the apex 33 and the intersection portion 31. The area between the apex 33 and the intersection portion 31 is referred to as "inner peripheral area 38". Accordingly, the indentation 30 of the blade 20 has the maximum thickness portion 36 in the inner peripheral area 38. As shown in FIG. 3, the blade thickness TL of the maximum thickness portion 36 is greatest of the thicknesses at the indentation 30. The blade thickness of the indentation 30 of the trailing edge 22 is partially greater radially inside of the apex 33 than the blade thickness of the apex 33, which is the deepest part of the indentation 30 in the direction of rotation DR. Accordingly, at the indentation 30 of the trailing edge 22, the blade thickness T1 of the intersection portion 31, which is the inner peripheral end portion of the indentation 30, and the blade thickness T3 of the apex 33 are smaller than the blade thickness TL of the maximum thickness portion 36.

FIG. 3 shows an example of the trailing edge 22. Accordingly, the configuration of the blade thickness of the indentation 30 at the trailing edge 22 needs only be formed as indicated below, and the configuration of the pressure surface 25 and the configuration of the suction surface 26 do not need to be identical. Therefore, for example, either the pressure surface 25 or the suction surface 26 may be constituted by a curved surface, and the other blade surface may be constituted by a flat surface. Alternatively, the pressure surface 25 and the suction surface 26 may be constituted by different curved surfaces.

It is desirable that as shown in FIG. 3, the maximum thickness portion 36 be between the intersection portion 31, which is the inner peripheral end portion of the indentation 30, and the apex 33 and be closer to the apex 33 than a center 37 between the intersection portion 31, which is the inner peripheral end portion of the indentation 30, and the apex 33.

[Operation of Axial Flow Fan 100]

When the axial flow fan 100 rotates in the direction of rotation DR shown in FIG. 1, each blade 20 presses ambient air with the pressure surface 25 to generate an airflow in the direction F shown in FIG. 1. Further, the rotation of the axial flow fan 100 produces a pressure difference between the pressure surface 25 and the suction surface 26 in an area around each blade 20. Specifically, the suction surface 26 is subjected to a lower pressure than the pressure surface 25.

[Effects of Axial Flow Fan 100]

Figure 9:
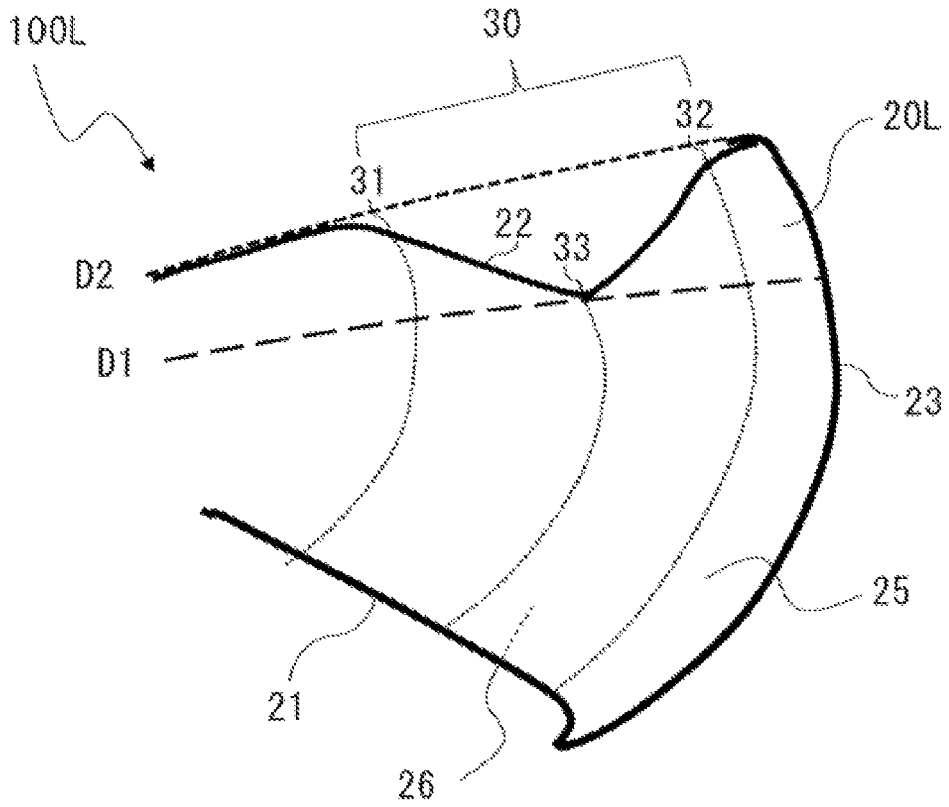
FIG. 9 is a plan view of an axial flow fan according to a comparative example as seen from an angle parallel with an axial direction of a rotation axis.
Figure 10:
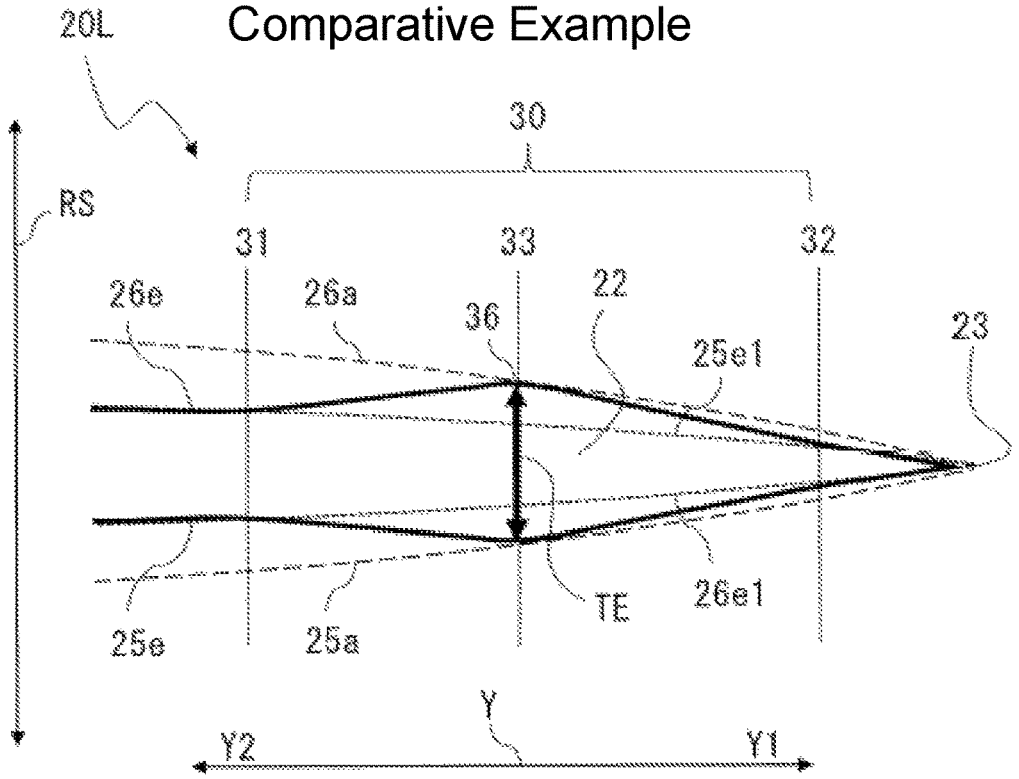
FIG. 10 is a side view conceptually showing a distribution of blade thickness of a trailing edge of a blade shown in FIG. 9.
Figure 11:
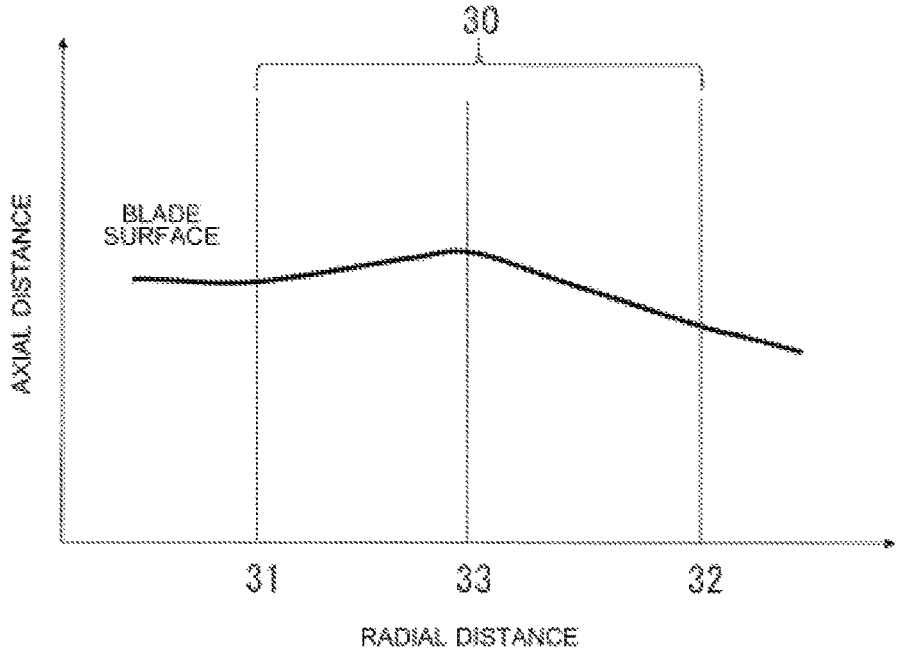
FIG. 11 is a diagram showing a blade surface distribution of the trailing edge of the axial flow fan according to the comparative example.

FIG. 9 is a plan view of an axial flow fan 100L according to a comparative example as seen from an angle parallel with an axial direction of a rotation axis RS. FIG. 10 is a side view conceptually showing a distribution of blade thickness of a trailing edge 22 of a blade 20L shown in FIG. 9. FIG. 11 is a diagram showing a blade surface distribution of the trailing edge 22 of the axial flow fan 100L according to the comparative example. In general, an axial flow fan is configured such that an air flow having flowed in through the leading edge of a blade is caused by a centrifugal force to flow radially outward. In the axial flow fan 100L according to the comparative example, an airflow flowing radially inward from the apex 33 passes through the indentation 30 in the process of moving radially outward in the axial flow fan 100L. Therefore, in the axial flow fan 100L, airflows flowing in radially inside of the apex 33 concentrate near the apex 33, so that a wind velocity is high near the apex 33.

As shown in FIGS. 10 and 11, the axial flow fan 100L according to the comparative example is configured such that the maximum thickness portion 36 is positioned at the apex 33. The axial flow fan 100L according to the comparative example is configured such that the blade thickness TE of the maximum thickness portion 36, which is positioned at the apex 33, is greatest of the blade thicknesses at the indentation 30. That is, as shown in FIGS. 10 and 11, the axial flow fan 100L according to the comparative example is configured such that the apex 33, which is close to the middle of the length of the blade as seen on identical radii, is greatest in blade thickness. In general, at a place at which a blade tip is thick, separation of an airflow from the blade produces a slipstream with a great difference in velocity between the pressure surface and the suction surface, so that a blade tip vortex is generated. In the axial flow fan 100L, in which the apex 33, at which a wind velocity is high, is greatest in blade thickness, separation of an airflow from the blade produces a slipstream with a great difference in velocity between the pressure surface and the suction surface, so that a blade tip vortex is easily generated. Meanwhile, the indentation needs a portion with an increased thickness for the securing of strength against a centrifugal force that is applied to the blade.

Figure 12:
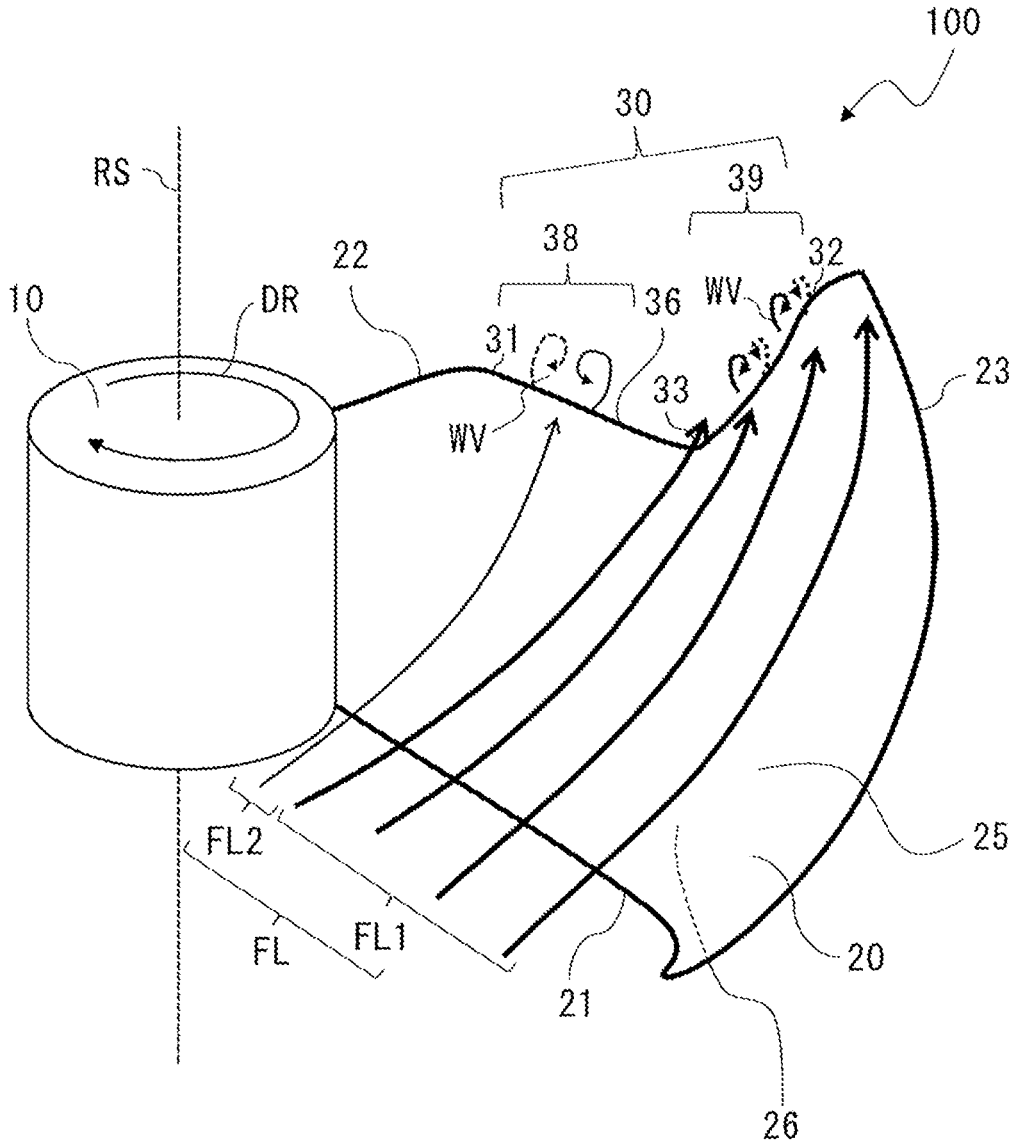
FIG. 12 is a schematic view showing a relationship between the blade of the axial flow fan according to Embodiment 1 and airflows.

FIG. 12 is a schematic view showing a relationship between the blade 20 of the axial flow fan 100 according to Embodiment 1 and airflows. The relationship between the blade 20 of the axial flow fan 100 according to Embodiment 1 and airflows is described with reference to FIG. 12. As compared with the axial flow fan 100L according to the comparative example, the axial flow fan 100 according to Embodiment 1 is configured such that the blade 20 has, at the indentation 30, a maximum thickness portion 36 at which a thickness of the blade 20 is maximum, and which is positioned radially inside of the apex 33. Since the axial flow fan 100 is configured such that a thickness of a portion of the blade that is positioned inside of the apex 33 is a maximum thickness, the axial flow fan 100 can make the difference in velocity between the pressure surface and the suction surface of a slipstream produced at the apex 33, at which a wind velocity is high, smaller than the axial flow fan 100L, and can inhibit blade tip vortices WV.

The inner peripheral area 38 in which the maximum thickness portion 36 is provided, and which is positioned inside (Y2 side) of the apex 33, produces a comparatively weak slipstream and hardly forms blade tip vortices WV, as an air flow FL2 reaching the blade tip is small in amount and low in velocity. Note, however, that the inner peripheral area 38 can secure strength against a centrifugal force by having the maximum thickness portion 36. That is, the inner peripheral area 38 prioritizes the strength of the blade 20 over the inhibition of blade tip vortices WV.

In an outer peripheral area 39 positioned outside (Y1 side) of the apex 33, an airflow reaching the blade tip of the trailing edge 22 is large in amount and high in velocity, as an airflow FL1 having flowed in through the leading edge 21 of the blade 20 is caused by a centrifugal force to flow radially outward. The outer peripheral area 39 is an area between the apex 33 and the trailing edge end portion 32, which is the outer peripheral end portion of the indentation 30. However, in the outer peripheral area 39, which is thinner in blade thickness than the inner peripheral area 38 and shorter in distance between the pressure surface 25 and the suction surface 26 than the inner peripheral area 38, blade tip vortices WV formed downstream of the blade tip, if any, are small and weak. That is, by prioritizing the flow of gas over the strength of the blade 20, the outer peripheral area 39 prioritizes the inhibition of blade tip vortices WV that are formed downstream of the blade tip.

In response to an airflow FL, the axial flow fan 100 can secure the strength of the indentation 30 in the inner peripheral area 38, through which a small amount of airflow passes, and, at the same time, can inhibit the generation of blade tip vortices WV, which are a cause of an energy loss, downstream of the blade tip of the trailing edge 22 in the outer peripheral area 39, through which a large amount of airflow passes. As a result, the axial flow fan 100 can achieve an energy-saving and low-noise air-sending device. In general, since the volume of air that passes is large on the outer periphery of a blade, the length of the blade tends to be great on the outer periphery. In the axial flow fan 100 according to Embodiment 1, the volume of the blade 20 is reduced by reducing the thickness of a portion of the blade 20 that is positioned outside of the apex 33. This makes it possible to reduce the weights of the blade 20 and the axial flow fan 100.

Further, the axial flow fan 100 is configured such that the maximum thickness portion 36 is between the intersection portion 31, which is the inner peripheral end portion of the indentation 30, and the apex 33 and is closer to the apex 33 than a center 37 between the intersection portion 31 which is the inner peripheral end portion of the indentation 30, and the apex 33. Since the apex 33 is subjected to a high load by a centrifugal force, the strength of the blade 20 can be secured by positioning the maximum thickness portion 36 closer to the apex 33 than the center 37.

Embodiment 2

Figure 13:
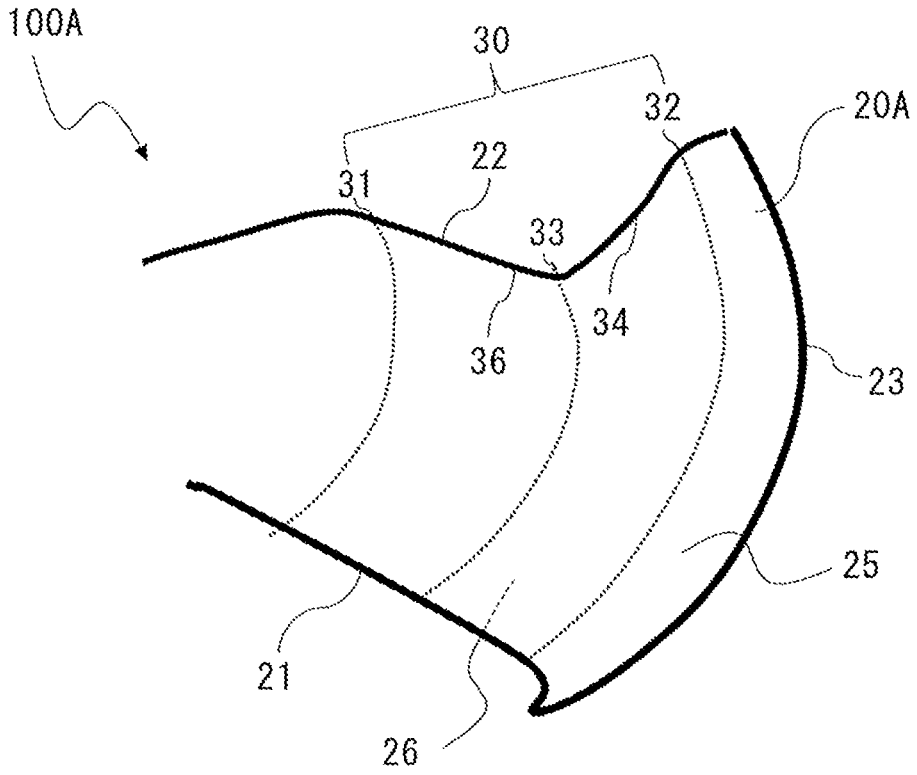
FIG. 13 is a plan view of an axial flow fan according to Embodiment 2 as seen from an angle parallel with an axial direction of a rotation axis.
Figure 14:
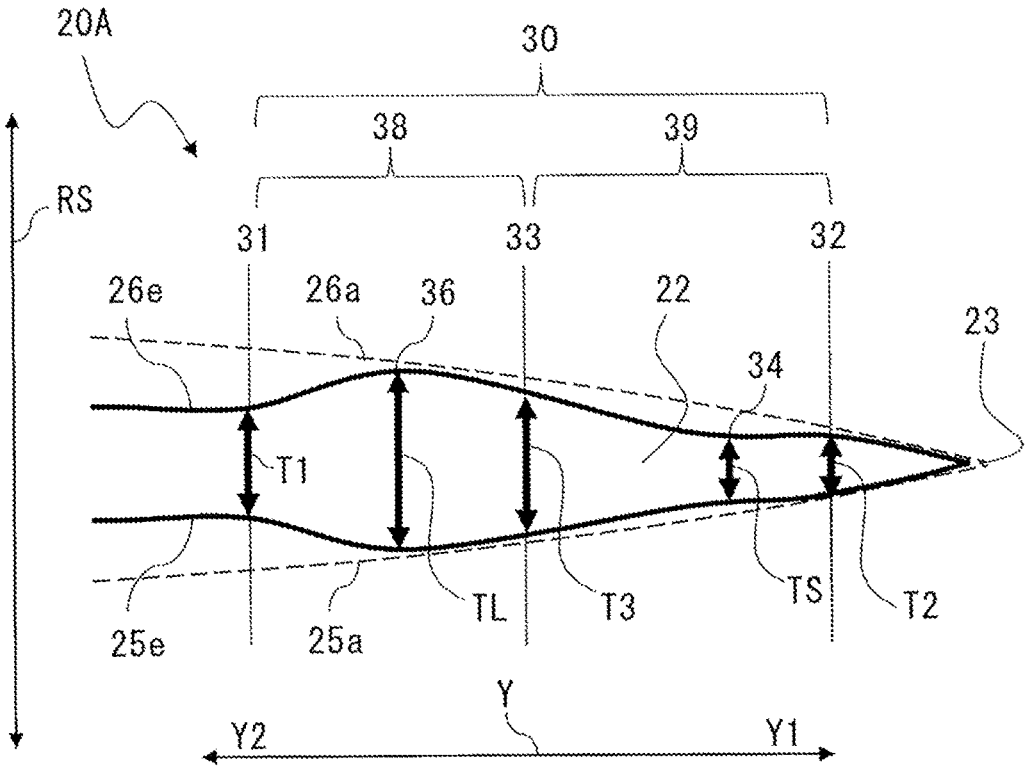
FIG. 14 is a side view conceptually showing an example of a distribution of blade thickness of a trailing edge of a blade shown in FIG. 13.
Figure 15:
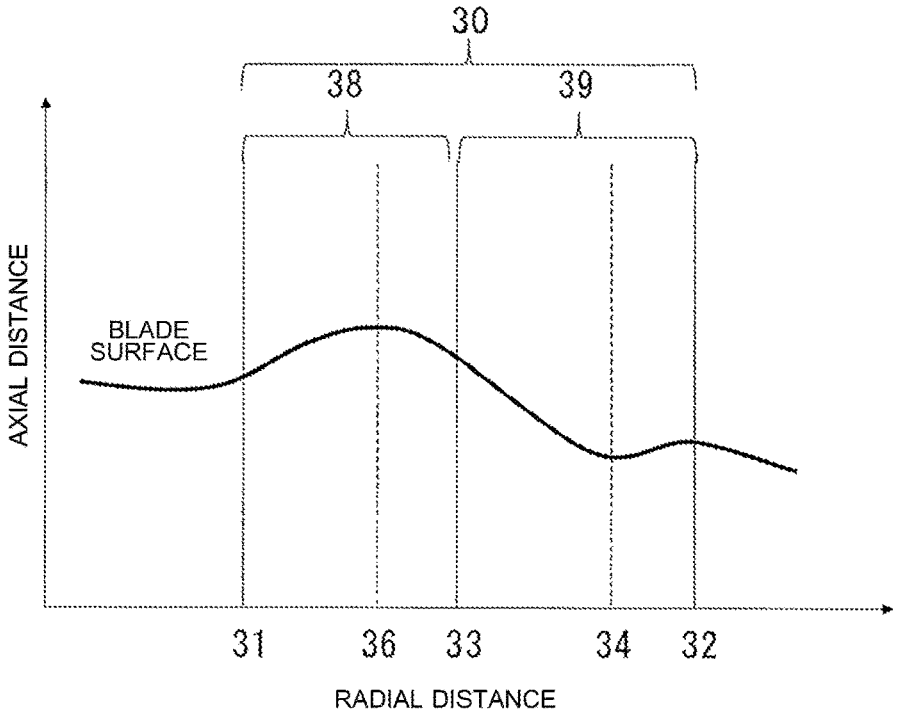
FIG. 15 is a diagram showing a blade surface distribution of the trailing edge of the axial flow fan according to Embodiment 2.

FIG. 13 is a plan view of an axial flow fan 100A according to Embodiment 2 as seen from an angle parallel with an axial direction of a rotation axis RS. FIG. 14 is a side view conceptually showing an example of a distribution of blade thickness of a trailing edge 22 of a blade 20A shown in FIG. 13. FIG. 15 is a diagram showing a blade surface distribution of the trailing edge 22 of the axial flow fan 100A according to Embodiment 2. FIG. 14 shows an example of the trailing edge 22, and as indicated by the blade surface of FIG. 15, the blade thickness of the blade 20A may be specified by either the pressure surface 25 or the suction surface 26. The axial flow fan 100A according to Embodiment 2 is intended to specify the configuration of a portion between the apex 33 and the trailing edge end portion 32, which is the outer peripheral end portion of the indentation 30. Components identical to those of the axial flow fan 100 or other axial flow fans of FIGS. 1 to 12 are given identical reference signs, and a description of such components is omitted.

The axial flow fan 100A according to Embodiment 2 is configured such that the blade 20A has, at the indentation 30, a minimum thickness portion 34 at which a thickness of the blade 20A is minimum, and which is positioned radially outside of the apex 33. The axial flow fan 100A according to Embodiment 2 is configured such that the blade 20A has, at the indentation 30, a minimum thickness portion 34 at which a thickness of the blade 20A is minimum, and which is positioned between the apex 33 and the trailing edge end portion 32, which is the outer peripheral end portion of the indentation 30. That is, the axial flow fan 100A according to Embodiment 2 has the minimum thickness portion 34 in the outer peripheral area 39. As shown in FIG. 14, the blade thickness TS of the maximum thickness portion 34 is smallest of the thicknesses at the indentation 30. That is, the indentation 30 of the trailing edge 22 decreases in blade thickness outward from the apex 33 and is smallest in blade thickness inside of the trailing edge end portion 32, which is the outer peripheral end portion of the indentation 30. The blade thickness of the indentation 30 of the trailing edge 22 is partially smaller radially outside of the apex 33 than the blade thickness of the apex 33, which is the deepest part of the indentation 30 in the direction of rotation DR. Accordingly, at the indentation 30 of the trailing edge 22, the blade thickness T2 of the trailing edge end portion 32, which is the outer peripheral end portion of the indentation 30, and the blade thickness T3 of the apex 33 are greater than the blade thickness TS of the minimum thickness portion 34.

As shown in FIGS. 14 and 15, the indentation 30 of the trailing edge 22 increases in blade thickness outward from the intersection point 31 and reaches a maximum blade thickness inside of the apex 33. Moreover, the indentation 30 of the trailing edge decreases in thickness of the blade outward from the maximum thickness portion 36, at which the thickness of the blade 20A is maximum, and is smallest in blade thickness at the minimum thickness portion 34, which is positioned between the apex 33 and the trailing edge end portion 32. Moreover, the indentation 30 of the trailing edge increases in blade thickness from the minimum thickness portion 34 toward the trailing edge end portion 32.

[Effects of Axial Flow Fan 100A]

The axial flow fan 100A according to Embodiment 2 is configured such that the blade 20A has, at the indentation 30, a minimum thickness portion 34 at which a thickness of the blade 20A is minimum, and which is positioned radially outside of the apex 33. The axial flow fan 100A according to Embodiment 2 is configured such that the blade 20A has, at the indentation 30, a minimum thickness portion 34 at which a thickness of the blade 20A is minimum, and which is positioned between the apex 33 and the trailing edge end portion 32, which is the outer peripheral end portion of the indentation 30. An airflow flowing along a blade surface is subjected to a centrifugal force to flow radially outward from the apex 33 of the indentation 30. In the axial flow fan 100A, a thickness of a portion of the blade that is positioned radially outside is reduced at the indentation 30, at which airflows concentrate. This makes it hard for an airflow separated from the blade tips of the pressure surface and the suction surface to be sucked in behind the blade tips, and makes it possible to reduce blade tip vortices WV that are generated downstream of the blade tips. As a result, the axial flow fan 100A reduces an energy loss attributed to the blade tip vortices WV and reduces disturbances of air flow, thereby making it possible to achieve energy conservation and reduce noise. Further, in the axial flow fan 100A, in which a thickness of a portion of the blade that is positioned radially outside is reduced, a reduced force is applied to the indentation 30 by a centrifugal force. This makes it possible to secure the strength of the axial flow fan 100A.

Embodiment 3

Figure 16:
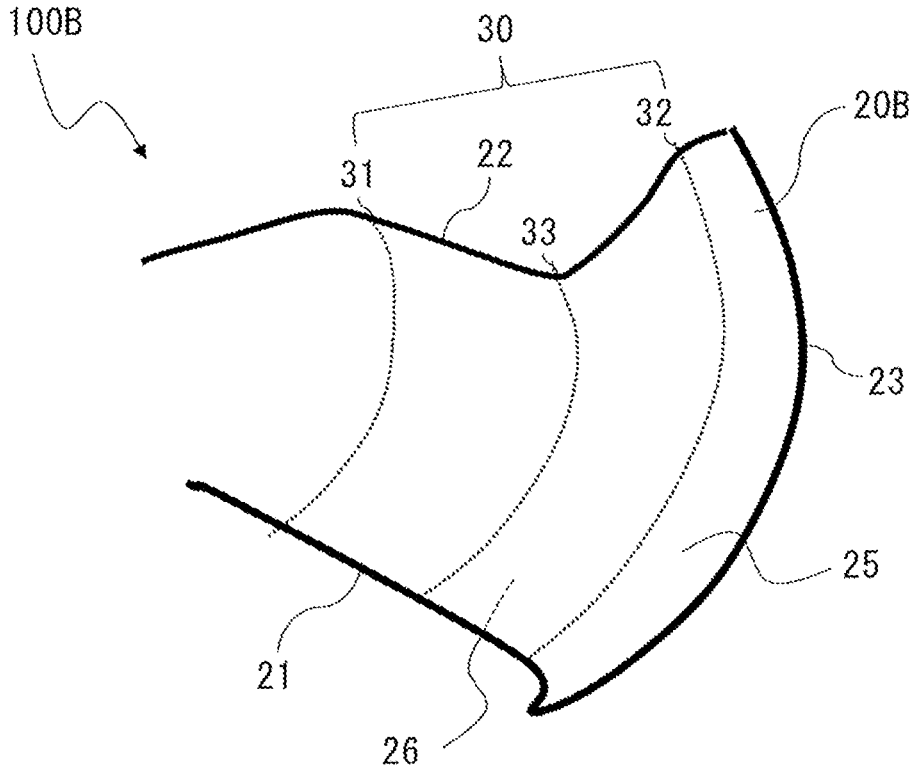
FIG. 16 is a plan view of an axial flow fan according to Embodiment 3 as seen from an angle parallel with an axial direction of a rotation axis.
Figure 17:
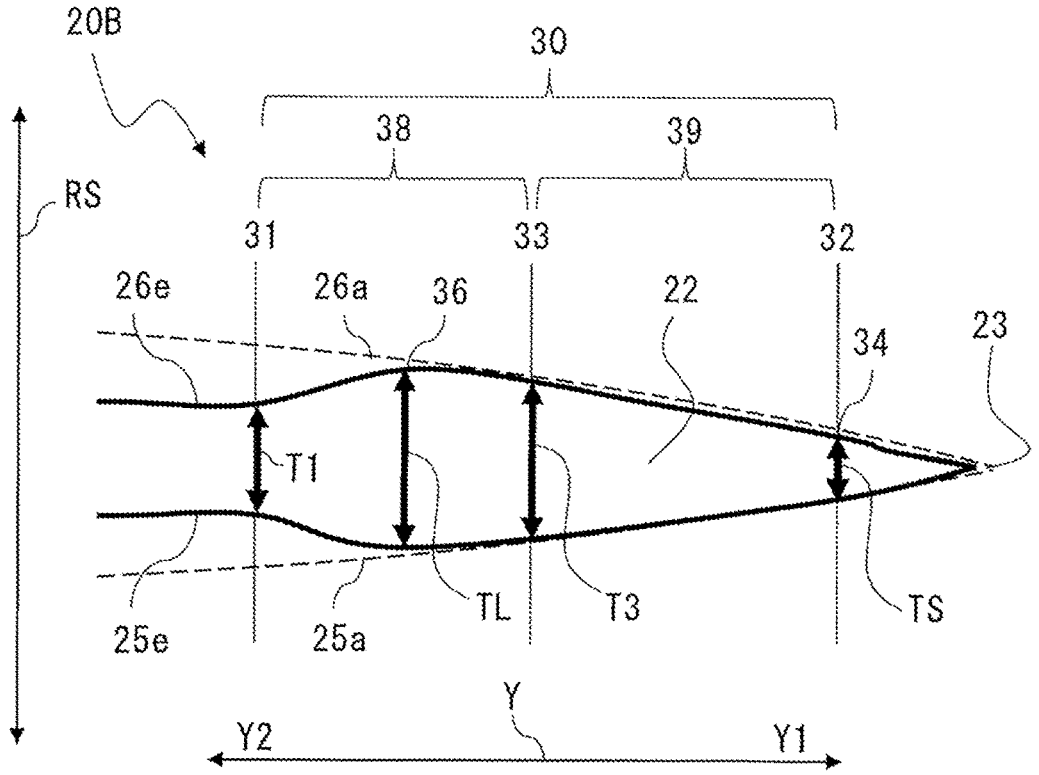
FIG. 17 is a side view conceptually showing an example of a distribution of blade thickness of a trailing edge of a blade shown in FIG. 16.
Figure 18:
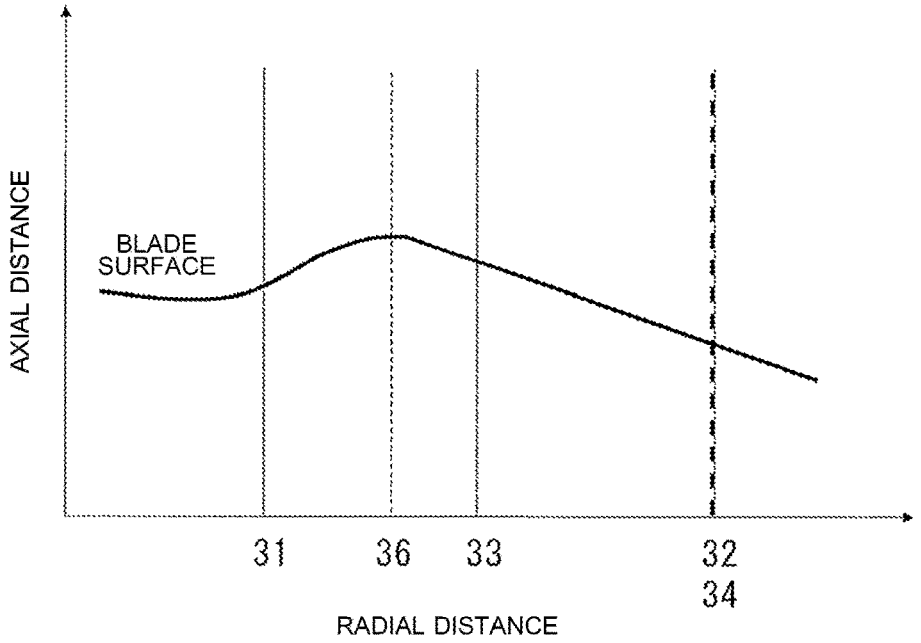
FIG. 18 is a diagram showing a blade surface distribution of the trailing edge of the axial flow fan according to Embodiment 3.

FIG. 16 is a plan view of an axial flow fan 100B according to Embodiment 3 as seen from an angle parallel with an axial direction of a rotation axis RS. FIG. 17 is a side view conceptually showing an example of a distribution of blade thickness of a trailing edge 22 of a blade 20B shown in FIG. 16. FIG. 18 is a diagram showing a blade surface distribution of the trailing edge 22 of the axial flow fan 100B according to Embodiment 3. FIG. 16 shows an example of the trailing edge 22, and as indicated by the blade surface of FIG. 18, the blade thickness of the blade 20B may be specified by either the pressure surface 25 or the suction surface 26. The axial flow fan 100B according to Embodiment 3 is intended to specify the configuration of a portion between the apex 33 and the trailing edge end portion 32, which is the outer peripheral end portion of the indentation 30. Components identical to those of the axial flow fan 100 or other axial flow fans of FIGS. 1 to 15 are given identical reference signs, and a description of such components is omitted.

The axial flow fan 100B according to Embodiment 3 is configured such that the blade 20B has, at the indentation 30, a minimum thickness portion 34 at which a thickness of the blade 20B is minimum, and which is positioned radially outside of the apex 33. The axial flow fan 100B according to Embodiment 3 is configured such that the blade 20B has, at the indentation 30, a minimum thickness portion 34 at which a thickness of the blade 20B is minimum, and which is positioned at the trailing edge end portion 32, which is the outer peripheral end portion of the indentation 30. That is, the indentation 30 of the trailing edge 22 decreases in blade thickness outward from the apex 33 and is smallest in blade thickness at the trailing edge end portion 32, which is the outer peripheral end portion of the indentation 30. The blade thickness of the indentation 30 of the trailing edge 22 is partially smaller radially outside of the apex 33 than the blade thickness of the apex 33, which is the deepest part of the indentation 30 in the direction of rotation DR. Accordingly, at the indentation 30 of the trailing edge 22, the blade thickness T3 of the apex 33 is greater than the blade thickness TS of the minimum thickness portion 34.

As shown in FIGS. 14 and 15, the indentation 30 of the trailing edge 22 increases in blade thickness outward from the intersection point 31 and reaches a maximum blade thickness inside of the apex 33. Moreover, the indentation 30 of the trailing edge decreases in blade thickness outward from the maximum thickness portion 36, at which the thickness of the blade 20B is maximum, toward the apex 33 and then toward the trailing edge end portion 32.

[Effects of Axial Flow Fan 100B]

The axial flow fan 100B according to Embodiment 3 is configured such that the blade 20B has, at the indentation 30, a minimum thickness portion 34 at which a thickness of the blade 20B is minimum, and which is positioned radially outside of the apex 33. The axial flow fan 100A according to Embodiment 2 is configured such that the blade 20B has, at the indentation 30, a minimum thickness portion 34 at which a thickness of the blade 20B is minimum, and which is positioned between the apex 33 and the trailing edge end portion 32, which is the outer peripheral end portion of the indentation 30. An airflow flowing along a blade surface is subjected to a centrifugal force to flow radially outward from the apex 33 of the indentation 30. In the axial flow fan 100B, a thickness of a portion of the blade that is positioned radially outside is reduced at the indentation 30, at which airflows concentrate. This makes it possible to reduce blade tip vortices WV that are generated downstream of the blade tips and, by reducing an energy loss and reducing disturbances of airflow, achieve energy conservation and reduced noise. Further, in the axial flow fan 100B, in which a thickness of a portion of the blade that is positioned radially outside is reduced, a reduced force is applied to the indentation 30 by a centrifugal force. This makes it possible to secure the strength of the axial flow fan 100B. Further, since the axial flow fan 100B is configured such that the thickness of the blade 20 gradually changes from the inner periphery toward the outer periphery of the blade 20, a local stress concentration hardly occurs. This makes it possible to better secure the strength of the axial flow fan 100B than that of the axial flow fan 100A.

Embodiment 4

Figure 19:
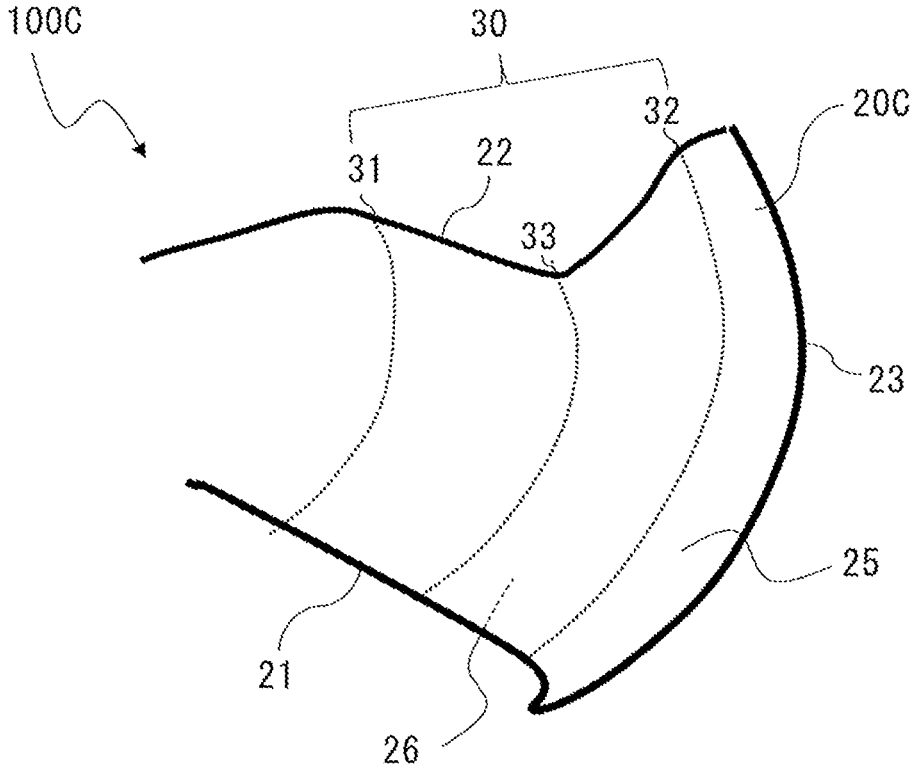
FIG. 19 is a plan view of an axial flow fan according to Embodiment 4 as seen from an angle parallel with an axial direction of a rotation axis.
Figure 20:
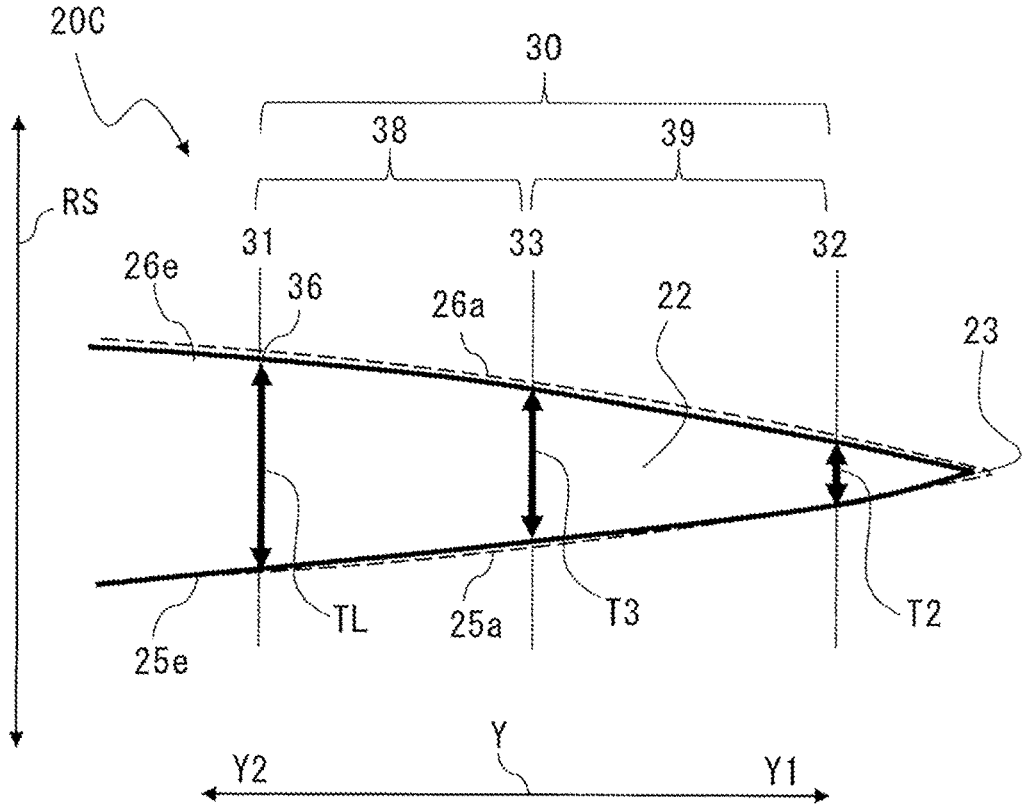
FIG. 20 is a side view conceptually showing an example of a distribution of blade thickness of a trailing edge of a blade shown in FIG. 19.
Figure 21:
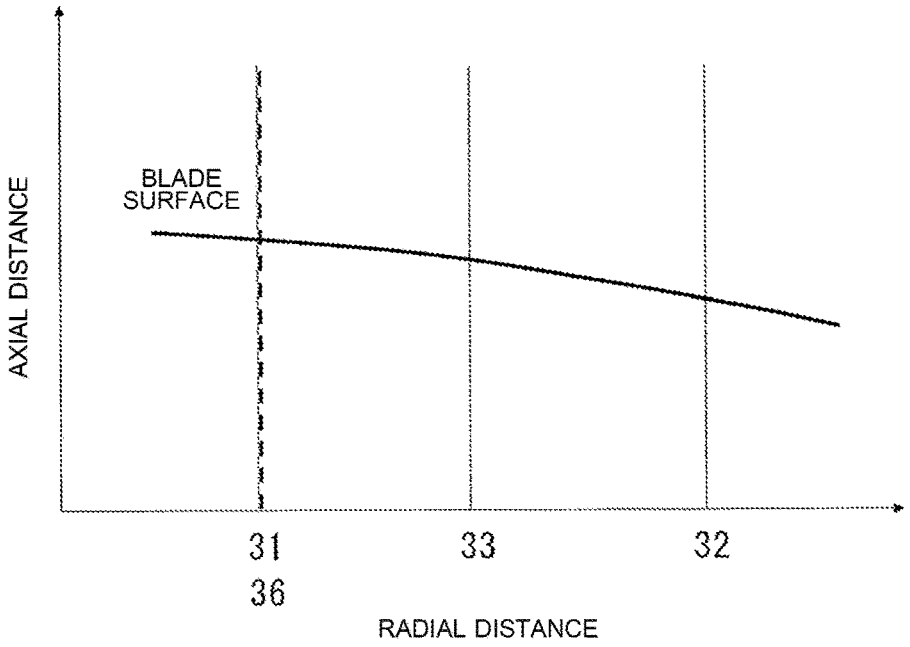
FIG. 21 is a diagram showing a blade surface distribution of the trailing edge of the axial flow fan according to Embodiment 4.

FIG. 19 is a plan view of an axial flow fan 100C according to Embodiment 4 as seen from an angle parallel with an axial direction of a rotation axis RS. FIG. 20 is a side view conceptually showing an example of a distribution of blade thickness of a trailing edge 22 of a blade 20C shown in FIG. 19. FIG. 21 is a diagram showing a blade surface distribution of the trailing edge 22 of the axial flow fan 100C according to Embodiment 4. FIG. 19 shows an example of the trailing edge 22, and as indicated by the blade surface of FIG. 21, the blade thickness of the blade 20C may be specified by either the pressure surface 25 or the suction surface 26. The axial flow fan 100C according to Embodiment 4 is intended to specify the configuration of a portion between the apex 33 and the intersection portion 31, which is the inner peripheral end portion of the indentation 30. Components identical to those of the axial flow fan 100 or other axial flow fans of FIGS. 1 to 18 are given identical reference signs, and a description of such components is omitted.

The axial flow fan 100C according to Embodiment 4 is configured such that the blade 20C has, at the indentation 30, a maximum thickness portion 36 at which a thickness of the blade 20C is maximum, and which is positioned radially inside of the apex 33. The axial flow fan 100C according to Embodiment 4 is configured such that the blade 20C has, at the indentation 30, a maximum thickness portion 36 at which a thickness of the blade 20C is maximum, and which is positioned at the intersection portion 31, which is the inner peripheral end portion of the indentation 30. That is, the indentation 30 of the trailing edge 22 increases in blade thickness inward from the apex 33 and reaches a maximum blade thickness at the intersection portion 31, which is the inner peripheral end portion of the indentation 30. The blade thickness of the indentation 30 of the trailing edge 22 is partially greater radially inside of the apex 33 than the blade thickness of the apex 33, which is the deepest part of the indentation 30 in the direction of rotation DR. Accordingly, at the indentation 30 of the trailing edge 22, the blade thickness T3 of the apex 33 is smaller than the blade thickness TL of the maximum thickness portion 36.

As shown in FIGS. 20 and 21, the indentation 30 of the trailing edge 22 decreases in blade thickness outward from the intersection portion 31 having the maximum thickness portion 36, at which the thickness of the blade 20B is maximum, toward the apex 33 and then toward the trailing edge end portion 32.

[Effects of Axial Row Fan 100C]

The axial flow fan 100C according to Embodiment 4 is configured such that the blade 20C has, at the indentation 30, a maximum thickness portion 36 at which a thickness of the blade 20C is maximum, and which is positioned at the intersection portion 31, which is the inner peripheral end portion of the indentation 30. The indentation 30 of the axial flow fan 100C according to Embodiment 4 decreases in blade thickness and mass toward the outer periphery, to which a centrifugal force is applied. This makes it possible to secure the strength of the blade 20. Further, the indentation 30 of the axial flow fan 100C according to Embodiment 4 has no abrupt change in blade thickness of the trailing edge 22 in a radial direction. The axial flow fan 100 according to Embodiment 4 reduces changes in strength of vortices that are generated inside and outside of the intersection portion 31, which is the inner peripheral end portion of the indentation 30, and reduces disturbances of airflow.

Embodiment 5

Figure 22:
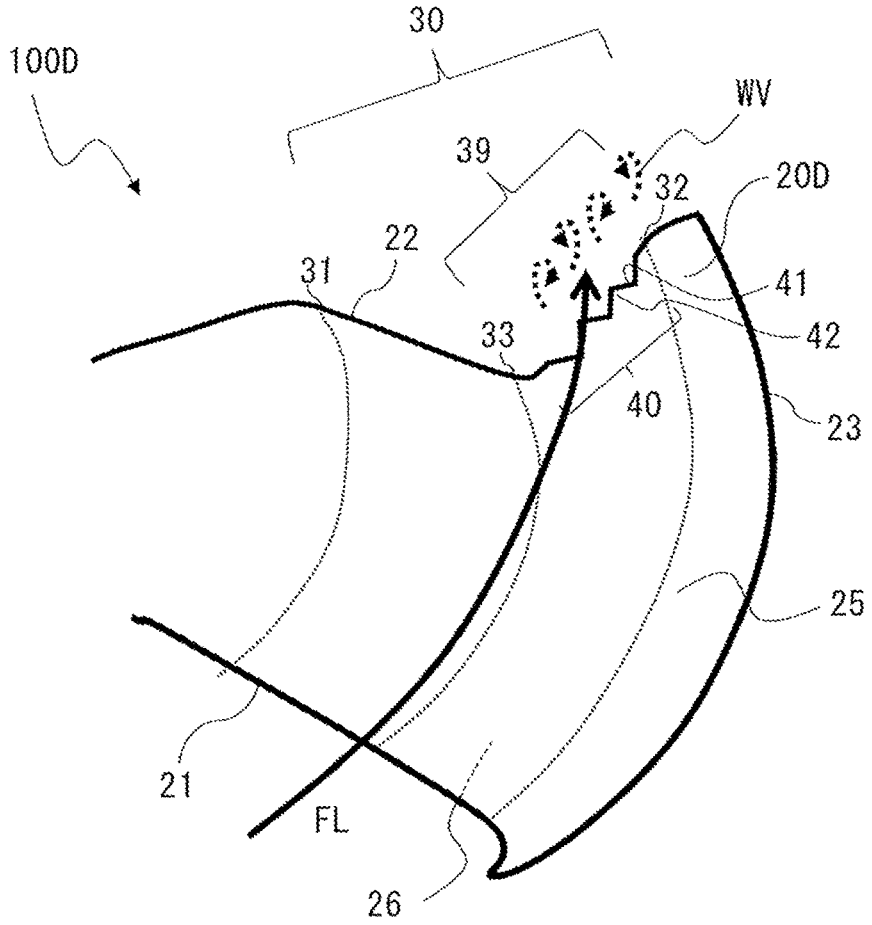
FIG. 22 is a plan view of an axial flow fan according to Embodiment 5 as seen from an angle parallel with an axial direction of a rotation axis.
Figure 23:
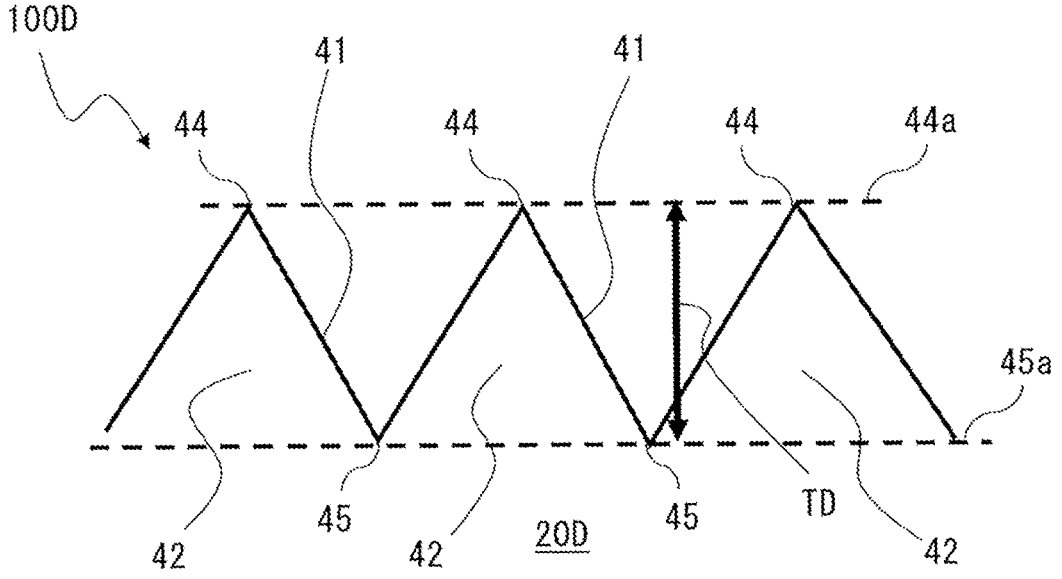
FIG. 23 is an enlarged view conceptually showing blade tip indentations shown in FIG. 22.

FIG. 22 is a plan view of an axial flow fan 100D according to Embodiment 5 as seen from an angle parallel with an axial direction of a rotation axis RS. FIG. 23 is an enlarged view conceptually showing blade tip indentations 40 shown in FIG. 22. Components identical to those of the axial flow fan 100 or other axial flow fans of FIGS. 1 to 21 are given identical reference signs, and a description of such components is omitted.

A blade 20D has, as a portion of the trailing edge 22 that is close to the outer periphery, a blade tip indentation 40 having a serrated shape. The blade tip indentation 40 is a second indentation of the blade 20D, and is a portion of at least the indentation 30. More specifically, the blade tip indentation 40, which is the second indentation, is positioned between the apex 33 and the trailing edge end portion 32, which is the outer peripheral end portion of the indentation 30. That is, the blade tip indentation 40, which is the second indentation, is positioned at least in the outer peripheral area 39 of the indentation 30. The blade tip indentation 40, which is the second indentation, needs only be positioned at least in the outer peripheral area 39 of the indentation 30, and may be a portion of the trailing edge 22 that is positioned outside of the trailing edge end portion 32. Accordingly, the indentation 30 has a blade tip indentation 40 having a serrated shape along the trailing edge as a portion of the indentation 30 that is positioned outside of the apex 33.

The blade tip indentation 40, which is the second indentation, includes a plurality of notches 41 and mountain portions 42 each positioned between one and another of the plurality of notches 41 and projecting in the direction of rotation DR, and is a series of the notches 41 and the mountain portions 42 along the trailing edge 22. In the example shown in FIG. 22, there are provided three notches 41 and two mountain portions 42. As a result, the portion of the trailing edge 22 that is close to the outer periphery has a serrated shape. Assume that, as shown in FIG. 23, a distance between a position 44*a* of an apex 44 and a position 45*a* of a valley portion 45 in the direction of rotation DR is a notch depth TD. The apex 44 is a top of a mountain portion 42 in the direction in which the mountain portion 42 projects, and the valley portion 45 is the position of a valley floor between one mountain portion 42 and another mountain portion 42. That is, the depth TD is the depth of a notch of the blade tip indentation 40, and is the difference in height between a mountain and a valley of the blade tip indentation 40.

The blade tip indentation 40 needs only include a plurality of notches 41 and may include any number of notches 41. Although, in the example shown in FIGS. 22 and 23, the notches 41 each has a triangular shape in a plan view of the axial flow fan 100D as seen from an angle parallel with the axial direction of the rotation axis RS, the shape of each of the notches 41 is not limited to such a shape. Some or all of the notches 41 of the blade tip indentation 40 may have different shapes.

Although, in the example shown in FIGS. 22 and 23, the mountain portions 42 each has a triangular shape in a plan view of the axial flow fan 100D as seen from an angle parallel with the axial direction of the rotation axis RS, the shape of each of the mountain portions 42 is not limited to such a shape. Some or all of the mountain portions 42 of the blade tip indentation 40 may have different shapes.

[Effects of Axial Flow Fan 100D]

The indentation 30 has a blade tip indentation 40 having a serrated shape along the trailing edge as a portion of the indentation 30 that is positioned outside of the apex 33. Since the portion of the indentation 30 that is close to the outer periphery is smaller in blade thickness than the apex 33, blade tip vortices WV that are generated at an end portion of the blade 20D by an airflow FL are small. By including the serrated blade tip indentation 40 on the outer periphery, at which a wind velocity is high, the axial flow fan 100D can create small disturbances in advance, further weaken the blade tip vortices WV, and thereby reduce trailing vortices.

Embodiment 6

Figure 24:
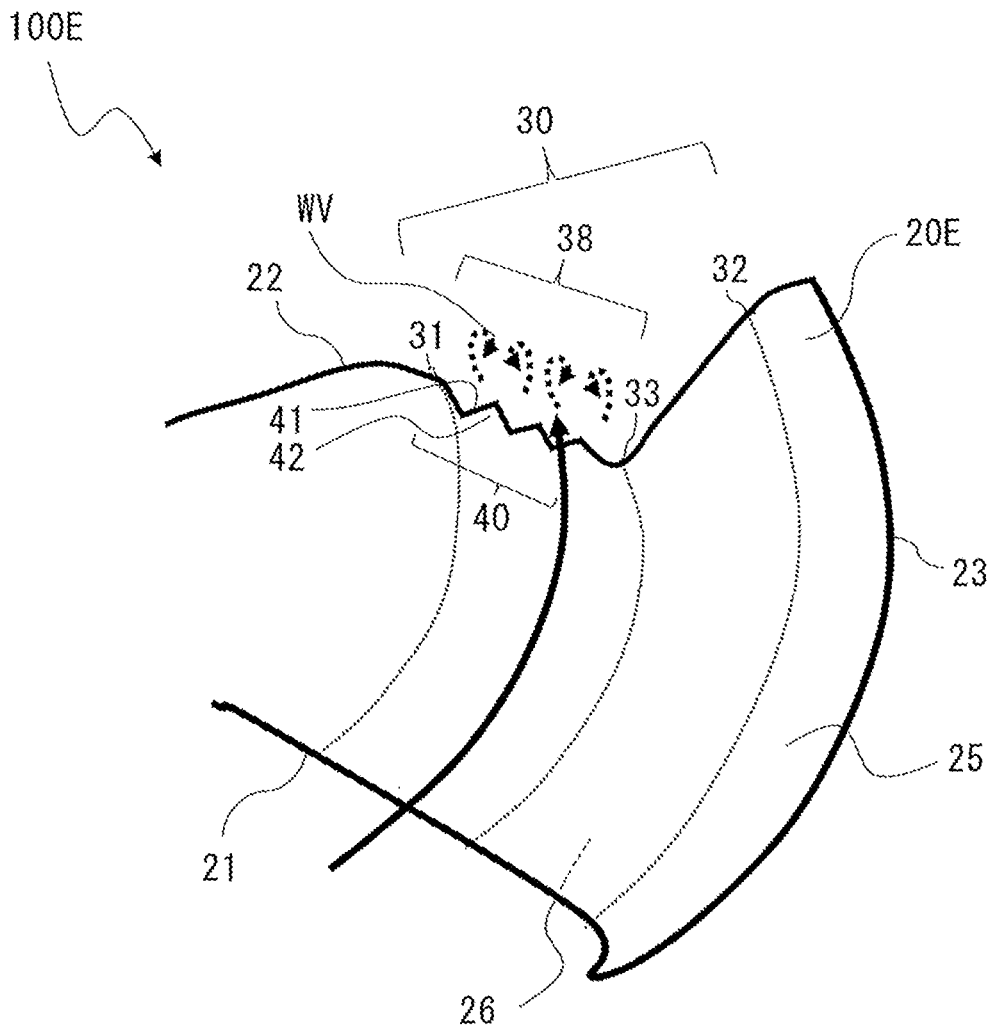
FIG. 24 is a plan view of an axial flow fan according to Embodiment 6 as seen from an angle parallel with an axial direction of a rotation axis.

FIG. 24 is a plan view of an axial flow fan 100E according to Embodiment 6 as seen from an angle parallel with an axial direction of a rotation axis RS. Components identical to those of the axial flow fan 100 or other axial flow fans of FIGS. 1 to 23 are given identical reference signs, and a description of such components is omitted.

A blade 20E has, as a portion of the trailing edge 22 that is close to the inner periphery, a blade tip indentation 40 having a serrated shape. The blade tip indentation 40 is a second indentation of the blade 20E, and is a portion of at least the indentation 30. More specifically, the blade tip indentation 40, which is the second indentation, is positioned between the apex 33 and the intersection portion 31, which is the inner peripheral end portion of the indentation 30. That is, the blade tip indentation 40, which is the second indentation, is positioned at least in the inner peripheral area 38 of the indentation 30. The blade tip indentation 40, which is the second indentation, needs only be positioned at least in the inner peripheral area 38 of the indentation 30, and may be a portion of the trailing edge 22 that is positioned inside of the intersection portion 31. Accordingly, the indentation 30 has a blade tip indentation 40 having a serrated shape along the trailing edge as a portion of the indentation 30 that is positioned inside of the apex 33.

[Effects of Axial Flow Fan 100E]

The indentation 30 has a blade tip indentation 40 having a serrated shape along the trailing edge as a portion of the indentation 30 that is positioned inside of the apex 33. By including the serrated blade tip indentation 40 on the inner periphery, at which a thickness of the blade 20 is great, the axial flow fan 100E can create small disturbances in advance also in a portion in which the strength of the blade 20 is secured, further weaken the blade tip vortices WV, and thereby reduce trailing vortices.

Embodiment 7

Figure 25:
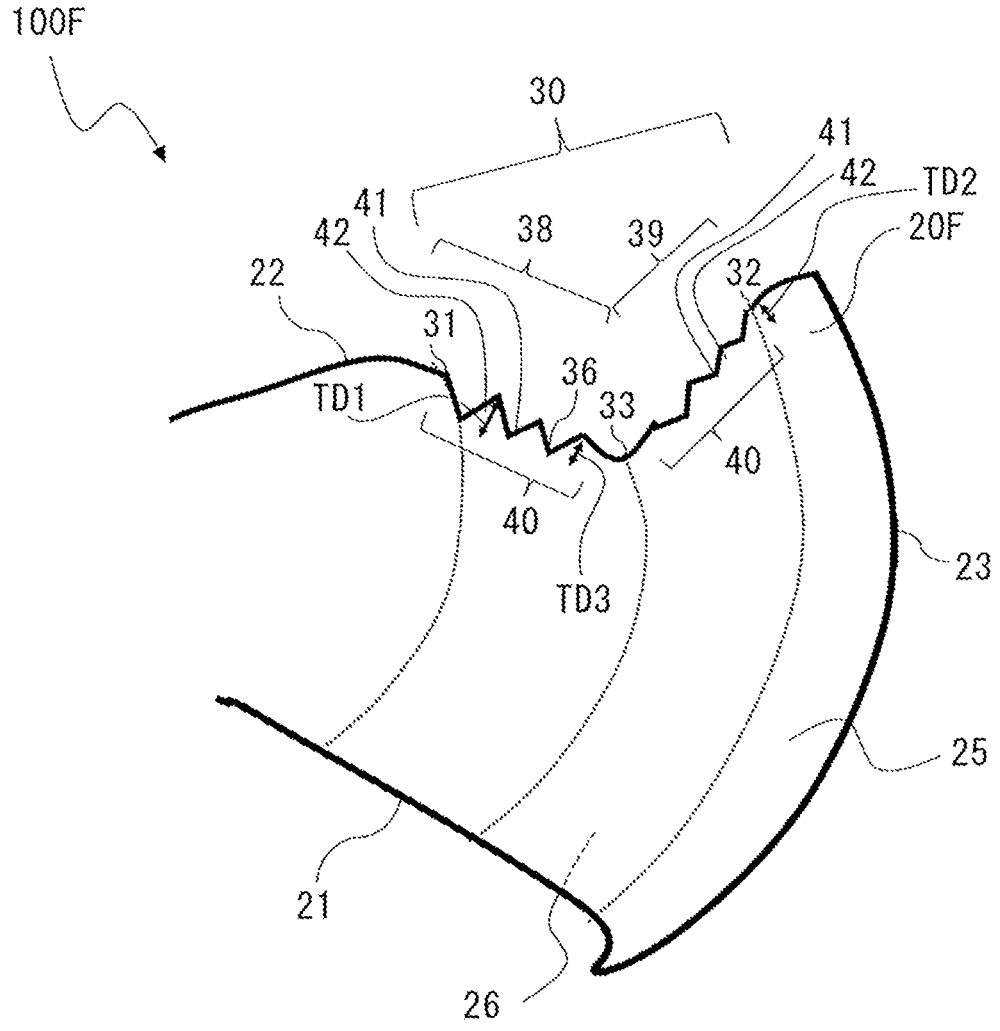
FIG. 25 is a plan view of an axial flow fan according to Embodiment 7 as seen from an angle parallel with an axial direction of a rotation axis.

FIG. 25 is a plan view of an axial flow fan 100F according to Embodiment 7 as seen from an angle parallel with an axial direction of a rotation axis RS. Components identical to those of the axial flow fan 100 or other axial flow fans of FIGS. 1 to 24 are given identical reference signs, and a description of such components is omitted.

The blade 20F has, as portions of the trailing edge 22 that are close to the outer periphery and the inner periphery, blade tip indentations 40 each having a serrated shape. The blade tip indentations 40 are second indentations of the blade 20F, and are portions of at least the indentation 30. More specifically, one of the blade tip indentations 40, which are the second indentations, is positioned between the apex 33 and the intersection portion 31, which is the inner peripheral end portion of the indentation 30, and the other of the blade tip indentations 40, which are the second indentations, is positioned between the apex 33 and the trailing edge end portion 32, which is the outer peripheral end portion of the indentation 30. That is, one of the blade tip indentations 40, which are the second indentations, is positioned in the inner peripheral area 38 of the indentation 30, and the other of the blade tip indentations 40, which are the second indentations, is positioned in the outer peripheral area 39 of the indentation 30.

One of the blade tip indentations 40, which are the second indentations, needs only be positioned at least in the inner peripheral area 38 of the indentation 30, and may be a portion of the trailing edge 22 that is positioned inside of the intersection portion 31. Further, the other of the blade tip indentations 40, which are the second indentations, needs only be positioned at least in the outer peripheral area 39 of the indentation 30, and may be a portion of the trailing edge 22 that is positioned outside of the trailing edge end portion 32. Accordingly, the indentation 30 has blade tip indentations 40 having serrated shapes along the trailing edge as portions of the indentation 30 that are positioned inside and outside of the apex 33.

It is desirable that the axial flow fan 100F be configured such that a depth TD1 of any one of the notches of the blade tip indentation 40 positioned inside of the apex 33 is greater than a depth TD2 of a notch of the blade tip indentation 40 positioned outside of the apex 33. Further, it is further desirable that a minimum value of the depth TD1 of each of the plurality of notches of the blade tip indentation 40 positioned inside of the apex 33 be greater than a maximum value of the depth TD2 of each of the plurality of notches of the blade tip indentation 40 positioned outside of the apex 33. The depth TD1 and the depth TD2 are defined by the depth TD described above.

It is desirable that the axial flow fan 100F be configured such that in the inner peripheral area 38, a depth TD1 of any one of notches of the blade tip indentation 40 positioned inside of the maximum thickness portion 36 is greater than a depth TD3 of a notch of the blade tip indentation 40 positioned outside of the maximum thickness portion 36. This configuration may be applied to the axial flow fan 100E described above. The depth TD3 is defined by the depth TD described above.

[Effects of Axial Flow Fan 100F]

The indentation 30 has a blade tip indentation 40 having a serrated shape along the trailing edge as a portion of the indentation 30 that is positioned outside of the apex 33. Since the portion of the indentation 30 that is close to the outer periphery is smaller in blade thickness than the apex 33, blade tip vortices WV that are generated at an end portion of the blade 20D by an airflow FL are small. By including the serrated blade tip indentation 40 on the outer periphery, at which a wind velocity is high, the axial flow fan 100F can create small disturbances in advance, further weaken the blade tip vortices WV, and thereby reduce trailing vortices. Furthermore, the indentation 30 has a blade tip indentation 40 having a serrated shape along the trailing edge as a portion of the indentation 30 that is positioned inside of the apex 33. By including the serrated blade tip indentation 40 on the inner periphery, at which a thickness of the blade 20 is great, the axial flow fan 100F can create small disturbances in advance also in a portion in which the strength of the blade 20 is secured, further weaken the blade tip vortices WV, and thereby reduce trailing vortices.

The indentation 30 is configured such that in a direction of rotation DR of the blade 20, a depth TD1 of any one of notches of the blade tip indentation 40 positioned inside of the apex 33 is greater than a depth TD2 of a notch of the blade tip indentation 40 positioned outside of the apex 33. By having a blade tip indentation 40 positioned on the inner periphery, at which a thickness of the blade 20 is great and a slipstream is easily generated, and formed by notches that are deeper than those of a blade tip portion 40 positioned on the outer periphery, the axial flow fan 100F can create small disturbances in advance, further weaken the blade tip vortices WV, and thereby reduce trailing vortices. Since the thickness of a portion of the blade 20 that is positioned on the inner periphery is greater than the thickness of a portion of the blade 20 that is positioned on the outer periphery, the axial flow fan 100F can better secure the strength of the portion of the blade 20 that is positioned on the inner periphery than the strength of the portion of the blade 20 that is positioned on the outer periphery. Therefore, in the axial flow fan 100F, the depth of a notch of the blade tip indentation 40 positioned on the inner periphery of the blade 20 can be made greater than the depth of a notch of the blade tip indentation 40 positioned on the outer periphery of the blade 20.

The indentation 30 is configured such that in a direction of rotation DR of the blade 20, a depth TD1 of any one of notches of the blade tip indentation 40 positioned inside of the maximum thickness portion 36 is greater than a depth TD3 of a notch of the blade tip indentation 40 positioned outside of the maximum thickness portion 36. By having a blade tip indentation 40 positioned on the inner periphery, at which a thickness of the blade 20 is great and a slipstream is easily generated, and formed by notches that are deeper than those of a blade tip portion 40 positioned on the outer periphery, the axial flow fan 100F can create small disturbances in advance, further weaken the blade tip vortices WV, and thereby reduce trailing vortices. Since the thickness of a portion of the blade 20 that is positioned on the inner periphery is greater than the thickness of a portion of the blade 20 that is positioned on the outer periphery, the axial flow fan 100F can better secure the strength of the portion of the blade 20 that is positioned on the inner periphery than the strength of the portion of the blade 20 that is positioned on the outer periphery. Therefore, in the axial flow fan 100F, the depth of a notch of the blade tip indentation 40 positioned on the inner periphery of the blade 20 can be made greater than the depth of a notch of the blade tip indentation 40 positioned on the outer periphery of the blade 20.

Embodiment 8

Embodiment 8 illustrates a case in which the axial flow fan 100 or other axial flow fans of Embodiments 1 to 7 are applied to an outdoor unit 50 serving as an air-sending device in a refrigeration cycle apparatus 70.

Figure 26:
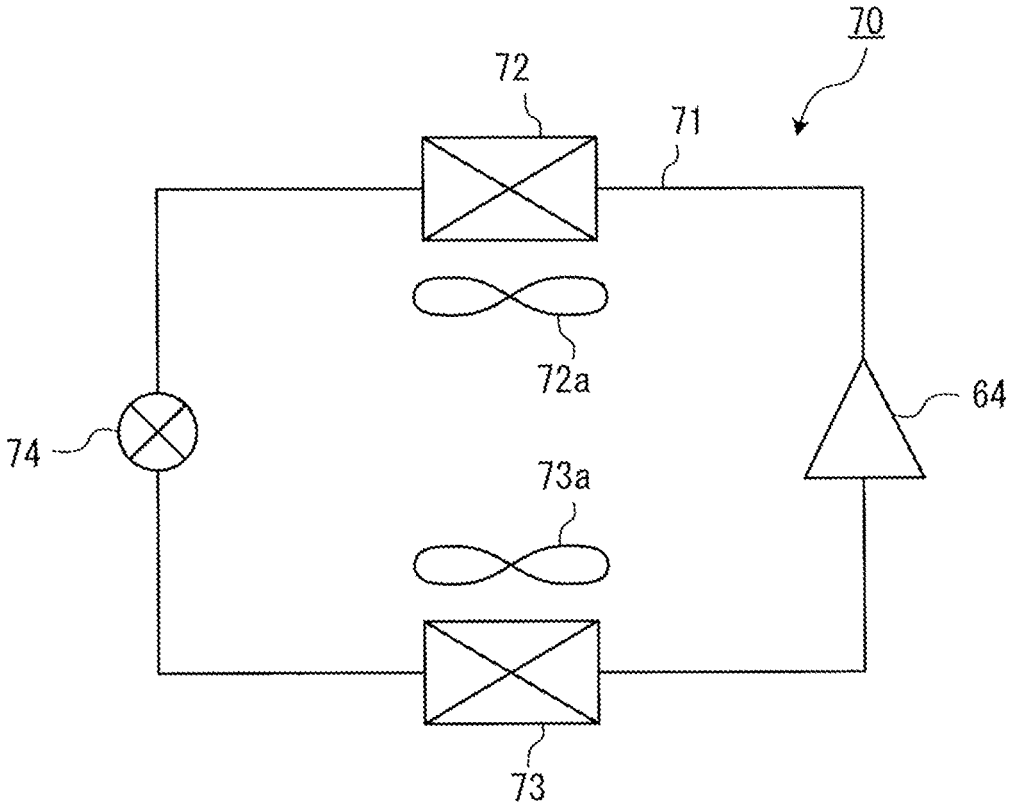
FIG. 26 is a schematic view of a refrigeration cycle apparatus according to Embodiment 8.

FIG. 26 is a schematic view of the refrigeration cycle apparatus 70 according to Embodiment 8. While the following describes a case in which the refrigeration cycle apparatus 70 is used in air conditioning, the refrigeration cycle apparatus 70 is not limited to use in air conditioning. The refrigeration cycle apparatus 70 is used for example in a refrigerator, a freezer, a self-vending machine, an air-conditioning apparatus, a refrigerating apparatus, or a water heater for a freezing or air-conditioning purpose.

As shown in FIG. 26, the refrigeration cycle apparatus 70 includes a refrigerant circuit 71 connecting a compressor 64, a condenser 72, an expansion valve 74, and an evaporator 73 in sequence by refrigerant pipes. The condenser 72 is provided with a condenser fan 72*a* configured to send air to the condenser 72 for use in heat exchange. Further, the evaporator 73 is provided with an evaporator fan 73*a* configured to send air to the evaporator 73 for use in heat exchange. At least either the condenser fan 72*a* or the evaporator fan 73*a* is constituted by the axial flow fan 100 or other axial flow fans of Embodiments 1 to 7. By providing the refrigerant circuit 71 with a flow switch device, such as a four-way valve, configured to switch the flow of refrigerant, the refrigeration cycle apparatus 70 may be configured to switch between heating operation and cooling operation.

Figure 27:
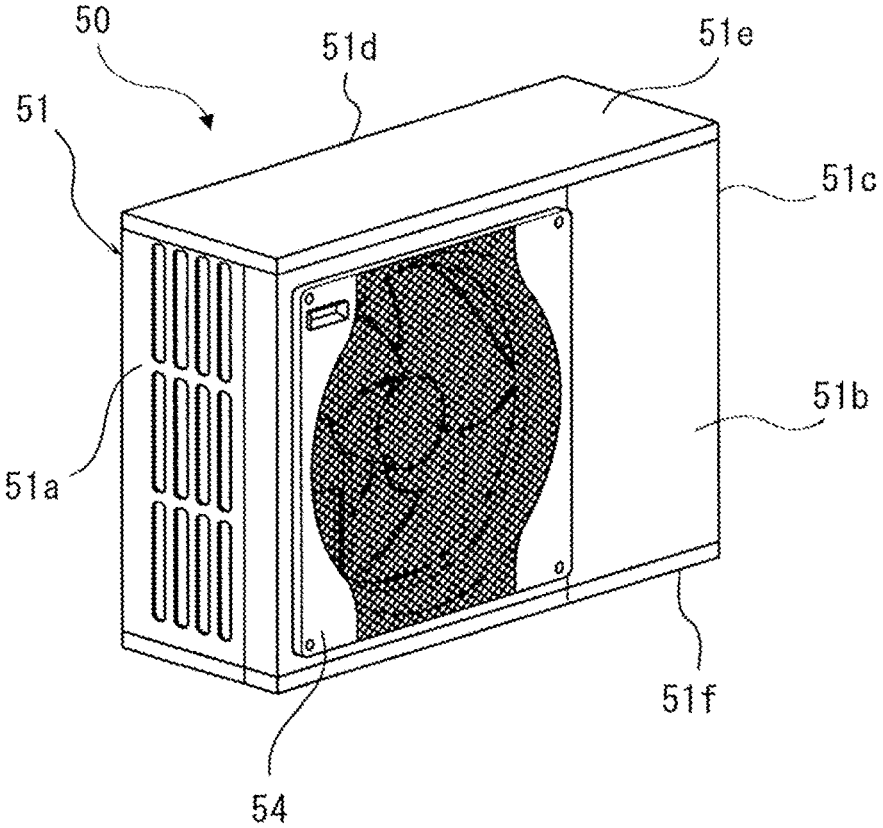
FIG. 27 is a perspective view of an outdoor unit serving as an air-sending device as seen from an air outlet side.
Figure 28:
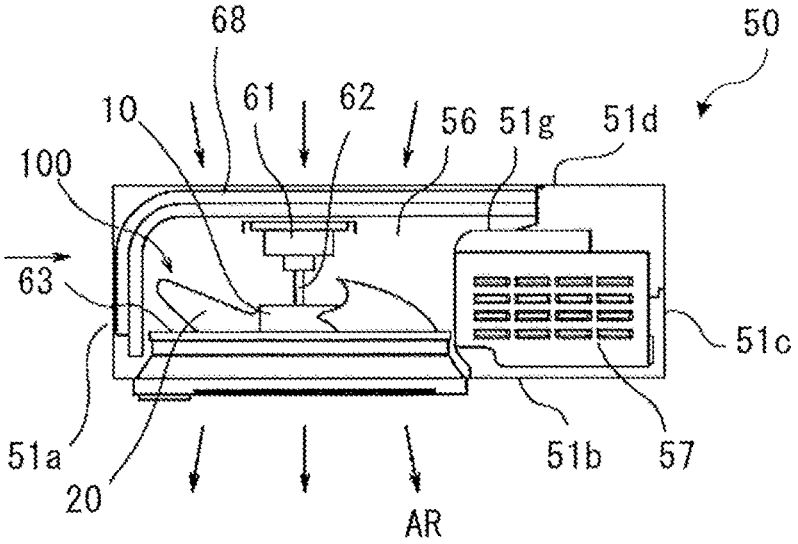
FIG. 28 is a diagram for explaining a configuration of the outdoor unit from the top.
Figure 29:
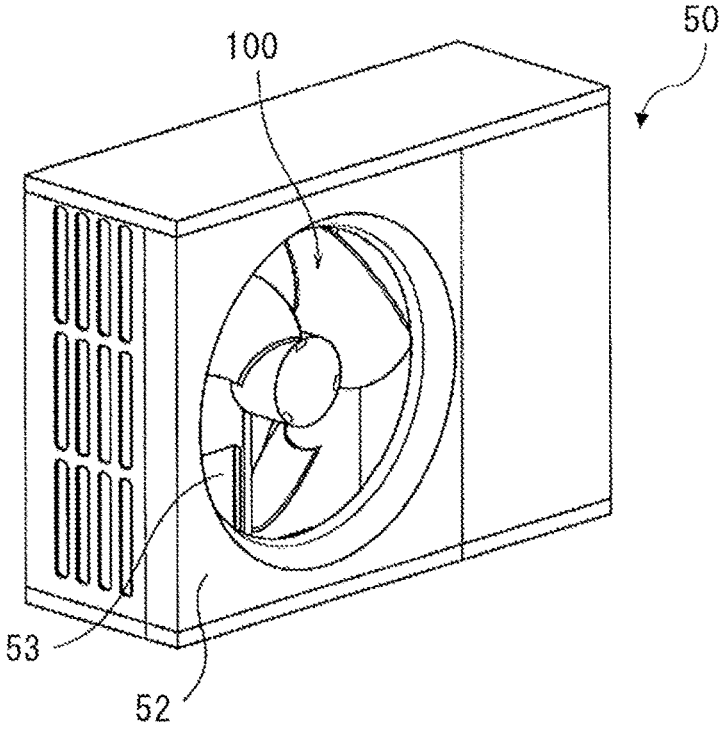
FIG. 29 is a diagram showing a state in which a fan grille has been removed from the outdoor unit.
Figure 30:
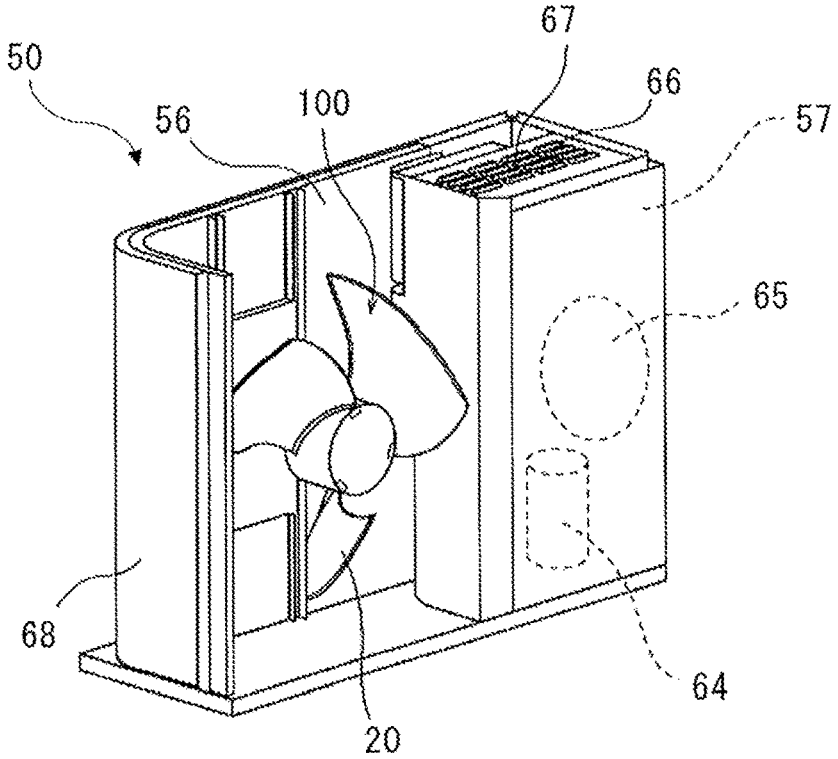
FIG. 30 is a diagram showing an internal configuration of the outdoor unit with the fan grille, a front panel, or other components removed from the outdoor unit.

FIG. 27 is a perspective view of the outdoor unit 50, which is an air-sending device, as seen from an air outlet side. FIG. 28 is a diagram for explaining a configuration of the outdoor unit 50 from the top. FIG. 29 is a diagram showing a state in which a fan grille has been removed from the outdoor unit 50. FIG. 30 is a diagram showing an internal configuration of the outdoor unit 50 with the fan grille, a front panel, or other components removed from the outdoor unit 50.

As shown in FIGS. 27 to 30, an outdoor unit body 51 serving as a casing is configured as a housing having a pair of left and right side surfaces 51*a* and 51*c*, a front surface 51*b*, a back surface 51*d*, a top surface 51*e*, and a bottom surface 51*f*. The side surface 51*a* and the back surface 51*d* are provided with openings through which air is suctioned from outside. Further, in the front surface 51*b*, a front panel 52 is provided with an air outlet 53 serving as an opening through which air is blown out. Furthermore, the air outlet 53 is covered with a fan grille 54, whereby safety measures are taken by preventing contact between an object outside the outdoor unit body 51 and the axial flow fan 100. The arrow AR of FIG. 28 indicates the flow of air.

The outdoor unit body 51 houses the axial flow fan 100 and a fan motor 61. The axial flow fan 100 is connected via a rotation shaft 62 to the fan motor 61, which is a drive source provided on the back surface 51*d*, and is driven by the fan motor 61 to rotate. The fan motor 61 applies a drive force to the axial flow fan 100.

The outdoor unit body 51 has its interior divided by a divider 51*g* serving as a wall into a blast room 56 in which the axial flow fan 100 is placed and a machine room 57 in which the compressor 64 or other machines are placed. In the blast room 56, the side surface 51*a* and the back surface 51*d* are provided with a heat exchanger 68 extending in a substantially L shape in a plan view. The heat exchanger 68 functions as the condenser 72 during heating operation and functions as the evaporator 73 during cooling operation.

A bellmouth 63 is disposed further radially outward than the axial flow fan 100 disposed in the blast room 56. The bellmouth 63 is located further outward than an outer peripheral end of each of the blades 20, and forms an annular shape along the direction of rotation of the axial flow fan 100. Further, the divider 51*g* is located at one side of the bellmouth 63, and a part of the heat exchanger 68 is located at the other side of the bellmouth 63.

The bellmouth 63 has its front edge connected to the front panel 52 of the outdoor unit 50 so as to surround the outer periphery of the air outlet 53. The bellmouth 63 may be integrated with the front panel 52 or may be prepared as a separate entity configured to be connected to the front panel 52. A flow passage between a suction side and a blowout side of the bellmouth 63 is formed by the bellmouth 63 as an air trunk near the air outlet 53. That is, the air trunk near the air outlet 53 is separated by the bellmouth 63 from another space in the blast room 56.

The heat exchanger 68, which is provided at a suction side of the axial flow fan 100, includes a plurality of fins arranged so that plate surfaces are parallel and a heat-transfer pipe passing through the fins in the direction in which the fins are arranged. Refrigerant circulating through the refrigerant circuit flows through the heat-transfer pipe. The heat exchanger 68 of the present embodiment is configured such that the heat-transfer pipe extends in a L shape from the side surface 51*a* to the back surface 51*d* of the outdoor unit body 51 and a plurality of the heat-transfer pipes meander through the fins. Further, the heat exchanger 68 constitutes the refrigerant circuit 71 of the air-conditioning apparatus by being connected to the compressor 64 via a pipe 65 or other pipes and further connected to an indoor-side heat exchanger, an expansion valve, or other components (not illustrated). Further, the machine room 57 accommodates a substrate box 66 containing a control substrate 67 configured to control the pieces of equipment mounted in the outdoor unit.

(Working Effects of Refrigeration Cycle Apparatus 70)

Embodiment 8 brings about advantages that are similar to those of a corresponding one of Embodiments 1 to 7. For example, the axial flow fans 100 to 100F inhibit the growth of a blade tip vortex at the trailing edge 22. Therefore, mounting any one or more of these axial flow fans 100 to 100F in the air-sending device allows the air-sending device to send an increased volume of air with low noise and high efficiency. Further, mounting the axial flow fan 100 or other axial flow fans in an air conditioner or a hot water supply outdoor unit that is the refrigeration cycle apparatus 70 constituted by the compressor 64 and the heat exchanger or other components makes it possible to attain a large volume of pass-by air with low noise and high efficiency and increase the amount of heat that is exchanged in the heat exchanger 68. Therefore, the refrigeration cycle apparatus 70 allows the pieces of equipment to achieve reduced noise and improved energy conservation. Further, mounting the axial flow fan 100 or other axial flow fans in the refrigeration cycle apparatus 70 allows the refrigeration cycle apparatus 70 to change to a heat exchanger 68 that is smaller than that used in a conventional axial flow fan and contribute to a reduction in amount of refrigerant.

The configurations shown in the foregoing embodiments show examples of contents of the present disclosure and may be combined with another publicly-known technology, and parts of the configurations may be omitted or changed, provided such omissions and changes do not depart from the scope of the present disclosure.

REFERENCE SIGNS LIST

10: hub, 20: blade, 20A: blade, 20B: blade, 20C: blade, 20D: blade, 20E: blade, 20F: blade, 20L: blade, 21: leading edge, 22: trailing edge, 22*b*: basal portion, 23: outer peripheral edge, 24: inner peripheral edge, 25: pressure surface, 25*a*: pressure surface, 25*e*: pressure surface, 26: suction surface, 26*a*: suction surface, 26*e*: suction surface, 30: indentation, 31: intersection portion, 32: trailing edge end portion, 33: apex, 34: minimum thickness portion, 36: maximum thickness portion, 37: center, 38: inner peripheral area, 39: outer peripheral area, 40: blade tip indentation, 41: notch, 42: mountain portion, 44: apex, 44*a*: position, 45: valley portion, 45*a*: position, 50: outdoor unit, 51: outdoor unit body, 51*a*: side surface, 51*b*: front surface, 51*c*: side surface, 51*d*: back surface, 51*e*: top surface. 51*f*: bottom surface, 51*g*: divider, 52: front panel, 53: air outlet, 54: fan grille, 56: blast room, 57: machine room, 61: fan motor, 62: rotation axis, 63: bellmouth, 64: compressor, 65: pipe, 66: substrate box, 67: control substrate, 68: heat exchanger, 70: refrigeration cycle apparatus, 71: refrigerant circuit, 72: condenser, 72*a*: condenser fan, 73: evaporator, 73*a*: evaporator fan, 74: expansion valve, 100: axial flow fan, 100A: axial flow fan, 100B: axial flow fan, 100C: axial flow fan, 100D: axial flow fan, 100E: axial flow fan, 100F: axial flow fan, 100L: axial flow fan

The invention claimed is:

1. An axial flow fan comprising:

a hub driven to rotate and configured to serve as a rotation axis of the axial flow fan; and a blade connected to the hub, the blade having a leading edge, and a trailing edge, the trailing edge having an indentation indenting toward the leading edge, the indentation narrowing from the trailing edge to the leading edge, the indentation defining a wall having an apex being a point closest to the leading edge from among the points constituting the indentation wall, the blade having, at the indentation wall, a maximum thickness portion at which a thickness of the blade is maximum, the maximum thickness portion is positioned radially inside of the apex.

2. The axial flow fan of claim 1, wherein the maximum thickness portion is between an inner peripheral end portion of the indentation and the apex, wherein the maximum thickness portion is closer to the apex than a center between the inner peripheral end portion and the apex.

3. The axial flow fan of claim 1, wherein the indentation has the maximum thickness portion at an inner peripheral end portion of the indentation.

4. The axial flow fan of claim 1, wherein the blade has, at the indentation wall, a minimum thickness portion at which a thickness of the blade is minimum, the minimum thickness portion is positioned radially outside of the apex.

5. The axial flow fan of claim 4, wherein the blade has, at the indentation wall, a minimum thickness portion at which a thickness of the blade is minimum, the minimum thickness portion is positioned between the apex and an outer peripheral end portion of the indentation.

6. The axial flow fan of claim 4, wherein the blade has, at the indentation wall, a minimum thickness portion at which a thickness of the blade is minimum, the minimum thickness portion is positioned at an outer peripheral end portion of the indentation.

7. The axial flow fan of claim 1, wherein the indentation has a blade tip indentation having a serrated shape along the trailing edge as a portion of the indentation that is positioned outside of the apex.

8. The axial flow fan of claim 1, wherein the indentation has blade tip indentation having a serrated shape along the trailing edge as a portion of the indentation that is positioned inside of the apex.

9. The axial flow fan of claim 1, wherein the indentation has blade tip indentations having serrated shapes along the trailing edge as portions of the indentation that are positioned inside and outside of the apex.

10. The axial flow fan of claim 9, wherein the indentation is configured such that in a direction in which the blade rotates, a depth of any one of notches of the blade tip indentation positioned inside of the apex is greater than a depth of a notch of the blade tip indentation positioned outside of the apex.

11. The axial flow fan of claim 9, wherein the indentation is configured such that in a direction in which the blade rotates, a depth of any one of notches of the blade tip indentation positioned inside of the maximum thickness portion is greater than a depth of a notch of the blade tip indentation positioned outside of the maximum thickness portion.

12. An air-sending device, comprising:

the axial flow fan of claim 1, a drive source configured to apply a drive force to the axial flow fan; and a casing configured to house the axial flow fan and the drive source.

13. A refrigeration cycle apparatus, comprising:

the air-sending device of claim 12; and a refrigerant circuit having a condenser and an evaporator, the air-sending device being configured to send air to at least either the condenser or the evaporator.

* * * * *